US007583906B2

(12) United States Patent
Bessho

(10) Patent No.: US 7,583,906 B2
(45) Date of Patent: Sep. 1, 2009

(54) IMAGE FORMING APPARATUS

(75) Inventor: Yuji Bessho, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 125 days.

(21) Appl. No.: 11/737,595

(22) Filed: Apr. 19, 2007

(65) Prior Publication Data

US 2007/0297817 A1 Dec. 27, 2007

(30) Foreign Application Priority Data

Jun. 21, 2006 (JP) ..... 2006-171509

(51) Int. Cl.
*G03G 15/08* (2006.01)

(52) U.S. Cl. ..... 399/30; 399/43; 399/60; 399/72

(58) Field of Classification Search ..... 399/27, 399/30, 60, 43, 49, 72, 74
See application file for complete search history.

(56) References Cited

U.S. PATENT DOCUMENTS 5,126,221 A 6/1992 Chiba et al.
5,260,753 A 11/1993 Haneda et al.
5,812,903 A * 9/1998 Yamada et al. ..... 399/42
7,409,171 B2 * 8/2008 Maeda et al. ..... 399/50

FOREIGN PATENT DOCUMENTS

| | | | |
|---|---|---|---|
| JP | 63-058374 | A | 3/1988 |
| JP | 03-002765 | A | 1/1991 |
| JP | 04-278967 | A | 10/1992 |
| JP | 05-142963 | A | 6/1993 |
| JP | 2000-231279 | A | 8/2000 |
| JP | 2006-47789 | A | 2/2006 |

* cited by examiner

*Primary Examiner*—David M Gray
*Assistant Examiner*—Gregory H Curran
(74) *Attorney, Agent, or Firm*—Canon U.S.A., Inc., IP Division

(57) ABSTRACT

An image forming apparatus includes a plurality of development units each using a developer including a toner and a carrier, a density detection unit configured to perform a density detection operation for detecting a density of a detection toner image formed by each of the plurality of development units, and a replenishment unit configured to perform a toner replenishment operation based on a result of the detection by the density detection unit. In the image forming apparatus, at least two of the plurality of development units use respective toners having different color depths in the same hue, and a frequency of the density detection operation using the development unit using a lighter color toner is higher than a frequency of the density detection operation using the development unit using a darker color toner.

6 Claims, 18 Drawing Sheets

TWO-COLOR PATCH MODE

SIX-COLOR PATCH MODE

ONE-COLOR PATCH MODE

FIVE-COLOR PATCH MODE

TWO-COLOR PATCH MODE

SIX-COLOR PATCH MODE

IMAGE FORMING APPARATUS

BACKGROUND OF THE INVENTION

1. Field of the Invention

The present invention relates to an electrophotographic image forming apparatus such as a copying machine or a printer.

2. Description of the Related Art

Conventionally, as an example of an image forming apparatus, such as a copying machine or a laser beam printer, which forms an image using an electrophotographic method, a full-color image forming apparatus is known which is configured to superpose color component images of Y (yellow), M (magenta), C (cyan), and Bk (black) to form an image.

In addition, another conventional full-color image forming apparatus is known which includes a plurality of image bearing members and a plurality of development units and uses two types of toners, namely, a light color toner and a dark color toner having the same spectroscopic characteristics. In such a conventional full-color image forming apparatus, a light color toner is loaded in at least one of the plurality of development units, and a dark color toner is loaded in at least one of the remaining plurality of development units. In this regard, Japanese Patent Application Laid-Open No. 2000-231279 discusses an image forming method for expressing a color having one type of spectroscopic characteristic using a lookup table for light color toner and a lookup table for dark color toner, such as the ones illustrated in FIG. 3. In this method, a light color toner is preferentially used for a low density portion, a mixture of a light color toner and a dark color toner is used for a medium density portion, and a dark color toner is preferentially used for a high density portion. Thus, coarseness of dots in a low density portion can be made less conspicuous, and the amount of toner consumption for a high density portion can be reduced. Furthermore, granularity in a low density portion can be reduced. Thus, image quality can be improved and a color reproduction range can be enlarged.

A color image formed with color toners as described above may have glossiness different from that of the surface of a print paper sheet because the surface of such color image is smoothed during heat fixing. Moreover, since the viscosity of a toner varies during heat fixing depending on the type of a binder resin of a color toner or the type of heat fixing, the glossiness of a color image may vary.

Users may have different desires for glossiness of a color image according to the kind or intended use of an image. With respect to a photograph document with a picture of a person or scenery, an image having a high glossiness is usually desired from the viewpoint of obtaining a high quality image. In this regard, for example, Japanese Patent Application Laid-Open No. 05-142963 and Japanese Patent Application Laid-Open No. 03-2765 each discuss a method for selecting a material quality of toners and fixing conditions for toners in a color copying machine so as to form a high glossy image. However, with the method discussed in each of Japanese Patent Application Laid-Open No. 05-142963 and Japanese Patent Application Laid-Open No. 03-2765, although the glossiness of an image portion formed with toners can be made high, the glossiness of a non-image portion may not be made high. Accordingly, the glossiness on a transfer material may not be made uniform.

In this regard, Japanese Patent Application Laid-Open No. 63-58374 and Japanese Patent Application Laid-Open No. 04-278967 each discuss a method for transferring and fixing a transparent toner onto a transfer material, in addition to color toners. Moreover, Japanese Patent Application Laid-Open No. 63-58374 and Japanese Patent Application Laid-Open No. 04-278967 each discuss a method for transferring and fixing a white toner onto a non-image portion.

As development devices using color toners and a transparent toner, a two-component development device is widely used considering the stability of image quality. In such a full-color image forming apparatus, in order to stabilize image quality, a developer density ratio T/D (the weight ratio of a toner to a developer) is detected, and based on a result of the detection, a toner replenishment timing is determined. According to a conventional method, the developer density ratio T/D is detected using an automatic toner replenishment sensor (ATR sensor), such as an inductance sensor or a sensor for optically detecting the density of a developer, which is provided in a development device. In addition, various methods for detecting the developer density ratio T/D are known in which a latent image for a reference image is formed on a photosensitive drum serving as an image bearing member, the image density of a reference toner image (patch) is detected by a density sensor, and the developer density ratio T/D is determined based on the determined image density.

Japanese Patent Application Laid-Open No. 2006-47789 discusses an apparatus configured to use a light color toner development device and a dark color toner development device to form a toner image for detection of an image density so as to perform image control. This apparatus is configured to set the frequency of forming a toner image for detection of an image density in the dark color toner development device higher than in the light color toner development device. This is intended to more frequently perform correction control in the dark color toner development device, taking into consideration that the higher density of a dark color toner causes a greater density variation.

However, in a case where an image is formed using toners having mutually different color depths in the same hue, namely, using a light color toner development device and a dark color toner development device, the following problems arise. That is, an extreme variation in a color tint occurs in a density area mainly formed with a light color toner development device. In addition, in a case where an image is formed using a transparent tone development device and a dark color toner development device, the glossiness of a non-image portion formed with a transparent toner can be very unstable. These phenomena are described in detail below with respect to their causes.

As described above, in the case of a development using a light color toner and a dark color toner, an image is formed according to a lookup table such as the one illustrated in FIG. 3. At a commonly used average use density, for example, when an input image signal value is in a range of 100 to 140 (100 or greater and 140 or smaller), an output image signal value output from a light color toner development device is approximately in a range of 200 to 255 (200 or greater and 255 or smaller). That is, a development is performed at a high density equivalent to the density of a solid image area. On the other hand, an output image signal value output from a dark color toner development device is very low. More specifically, in forming an image having an average density, the amount of toner consumed in the light color toner development device is several times larger than the amount of toner consumed in the dark color toner development device.

In the case of a two-component development device, in order to stabilize the developer density, the amount of consumed toner is calculated using a detection unit to replenish a toner according to a result of the calculation. However, if an extreme amount of toner is consumed, the toner density can vary in a development device for the following reasons. This phenomenon is described in detail below.

As illustrated in FIG. 13, a two-component development device 132 stores therein a two-component developer including a nonmagnetic toner and a magnetic carrier. First and second stirring and carrying units 123 and 124 supply the developer to the surface of a development sleeve 121, which serves as a developer bearing member. The developer is retained on the surface of the development sleeve 121 in the form of a magnetic brush with a magnetic force from a magnet roller, which serves as a magnetic field generation unit, in the development sleeve 121. The retained developer is carried to a portion facing a photosensitive drum 101 (development area) according to the rotation of the development sleeve 121. A developer return member 126 and an ear height restriction member 127 cut an ear of the magnetic brush of the developer to properly maintain the amount of a developer carried to the development area.

The inside of the development device 132 is partitioned into a development chamber (a first chamber) 129 and a stirring chamber (a second chamber) 130 with a partition wall 128 extending in a direction perpendicular to the drawing surface of FIG. 13. The first and second developer stirring and carrying units 123 and 124 are disposed in the development chamber 129 and the stirring chamber 130, respectively.

The first stirring and carrying unit 123 is disposed substantially in parallel to an axial direction of the development sleeve 121 below the development chamber 129. The first stirring and carrying unit 123 has a screw structure having blade members around a rotation shaft thereof in a spiral-like form. The first stirring and carrying unit 123 rotates to carry a developer in the development chamber 129 in one direction along the axis of the development sleeve 121.

The second stirring and carrying unit 124 has a screw structure similar to that of the first stirring and carrying unit 123. However, the second stirring and carrying unit 124 has blade members around a rotation shaft thereof in a spiral-like manner having an opposite direction to that of the first stirring and carrying unit 123. The second stirring and carrying unit 124 is disposed substantially in parallel to the first stirring and carrying unit 123 below the stirring chamber 130. The second stirring and carrying unit 124 rotates in the same direction as the stirring and carrying unit 123 to carry a developer in the stirring chamber 130 in a direction opposite to that of the stirring and carrying unit 123.

At front and back edge portions of the partition wall 128, developer paths 128*a* and 128*b* are provided, which mutually connect the development chamber 129 and the stirring chamber 130, as illustrated in FIG. 14. As the developer is carried by the stirring and carrying units 123 and 124, the developer in the development chamber 129 flows into the stirring chamber 130 via the developer path 128 of the partition wall 128. The developer in the stirring chamber 130 flows into the development chamber 129 via the other developer path 128 of the partition wall 128. Thus, the developer circulates between the development chamber 129 and the stirring chamber 130.

The development device 132 includes a toner replenishment tank (not shown). A toner is supplied into the stirring chamber 130 from the toner replenishment tank at a position upstream of the second stirring and carrying unit 124 under the control of a developer density control device (not shown). The developer inside the development chamber 129, whose toner density is lowered due to consumption of toner by development, is supplied into the stirring chamber 130 by the first stirring and carrying unit 123. Then, the developer is stirred and mixed by the second stirring and carrying unit 124 with the developer already existing in the development chamber 129 and the toner supplied from the toner replenishment tank to uniform the toner density of the developer. Subsequently, the developer is carried into the development chamber 129.

However, in this case, if an extremely large amount of toner is consumed, the amount of toner consumed on the development sleeve 121 naturally becomes large. Accordingly, the developer in the development chamber 129 is supplied into the stirring chamber 130 by the first stirring and carrying unit 123 in a state in which the toner density of the developer is extremely lowered due to an extreme consumption of toner. Accordingly, even if the developer is stirred and mixed by the second stirring and carrying unit 124, the toner density of the developer cannot be easily made uniform. Thus, the toner density in the development device 132 may become nonuniform. When the toner density varies, the amount of toner charge also varies. As a result, the image density also varies. Accordingly, depending on the circulation of the developer in the development device 132, in the case where the amount of toner consumption is extremely large, the effect of uniforming the toner density in the development device 132 cannot be sufficient. Thus, the toner density in the development device 132 may not be made uniform. As a result, the image density may vary. Accordingly, the quality of images degrades with a different hue for each image.

In this regard, the amount of toner consumed in a light color toner development device can be reduced by reducing the amount of toner necessary for development using a light color toner at an average density value while lowering the output level of a medium image signal for a light color toner in a light color toner lookup table. In this case, however, an advantage of using a light color toner for reducing granularity in a low-density portion can be lost.

In addition, a transparent toner is used to alleviate unevenness in an image surface by forming an image in an area in which a color toner does not exist. Accordingly, in the case of development using a transparent toner, depending on its state of use, an amount of development toner equal to or larger than an amount of toner formed with a plurality of color toners is necessary. Thus, using a transparent toner creates a problem similar to the problems in the case of development using a light color toner.

SUMMARY OF THE INVENTION

An embodiment of the present invention is directed to suppressing a variation in a color tint with an image forming apparatus configured to perform development using toners having different densities in the same hue.

Furthermore, an embodiment of the present invention is directed to stably supplying an image having uniform image glossiness with an image forming apparatus configured to perform development using a colorless toner.

According to an aspect of the present invention, an embodiment is directed to an image forming apparatus including: a plurality of development units each configured to develop an electrostatic image using a developer including a toner and a carrier, wherein at least two development units of the plurality of development units are configured to use respective toners having different color depths in a same hue; a density detection unit configured to perform a density detection operation for forming a detection toner image selectively using the plurality of development units and for detecting a density of the formed detection toner image, wherein a frequency of the density detection operation using the development unit using a lighter color toner of the two development units is higher than a frequency of the density detection operation using the development unit using a darker color toner of the two development units; and a replenishment unit configured to perform a toner replenishment operation based on a result of the detection by the density detection unit According to another aspect of the present invention, an embodiment is directed to an image forming apparatus including: a plurality of development units each configured to develop an electrostatic image using a developer including a toner and a carrier, wherein at least one development unit of the plurality of development units is configured to use a colorless toner; a density detection unit configured to perform a density detection operation for forming a detection toner image selectively using the plurality of development units and for detecting a density of the formed detection toner image, wherein a frequency of the density detection operation using the development unit using the colorless toner is higher than a frequency of the density detection operation using any one of the other development units; and a replenishment unit configured to perform a toner replenishment operation based on a result of the detection by the density detection unit.

Further features and aspects of the present invention will become apparent from the following detailed description of exemplary embodiments with reference to the attached drawings.

BRIEF DESCRIPTION OF THE DRAWINGS

The accompanying drawings, which are incorporates in and constitute a part of the specification, illustrate exemplary embodiments, features, and aspects of the invention and, together with the description, serve to explain the principle of the invention.

DETAILED DESCRIPTION OF THE EMBODIMENTS

Various exemplary embodiments, features and aspects of the present invention will now herein be described in detail with reference to the drawings. It is be noted that the relative arrangement of the components, the numerical expressions, and numerical values set forth in these embodiments are not intended to limit the scope of the present invention unless it is specifically stated otherwise.

First Exemplary Embodiment

Figure 1:
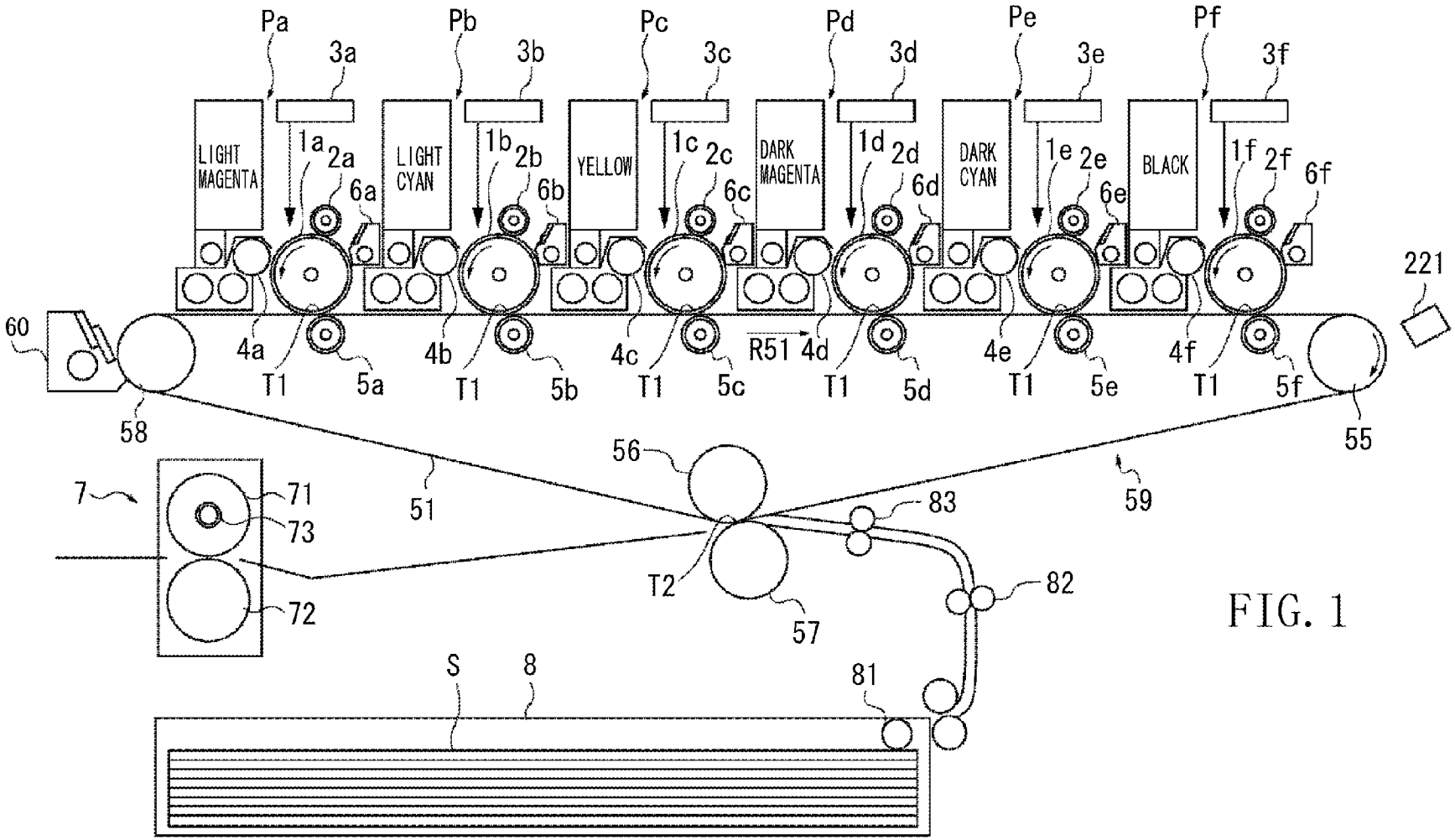
FIG. 1 illustrates an exemplary configuration of an image forming apparatus according to a first exemplary embodiment of the present invention.

FIG. 1 illustrates an image forming apparatus according to a first exemplary embodiment of the present invention. The image forming apparatus is an electrophotographic image forming apparatus using an intermediate transfer belt (intermediate transfer member) 51 as a transfer medium.

Process units are disposed from upstream to downstream along a direction of rotation of the intermediate transfer belt 51 (a direction of movement, namely, a direction indicated by an arrow R51 in FIG. 1). That is, the process units are disposed in order of a first process unit Pa, a second process unit Pb, a third process unit Pc, a fourth process unit Pd, a fifth process unit Pe, and a sixth process unit Pf.

In the present exemplary embodiment, the first process unit Pa through the sixth process units Pf, in the following order, respectively form toner images of light magenta (ML), light cyan (CL), yellow (Y), dark magenta (MH), dark cyan (CH), and black (K). The process units Pa, Pb, Pc, Pd, Pe, and Pf include drum-like electrophotographic photosensitive members (hereinafter referred to as "photosensitive drums") 1*a*, 1*b*, 1*c*, 1*d*, 1*e*, and 1*f*, respectively, which serve as image bearing members. The photosensitive drums 1*a* through 1*f* are rotationally driven by a drive unit (not shown) at a predetermined process speed (peripheral velocity) in a direction indicated by an arrow in FIG. 1.

In an embodiment, each of the process units Pa and Pb is configured so that an optical density of light magenta or light cyan after fixing is at 0.8 when the amount of toner on a transfer material is 0.5 mg/cm$^2$. In addition, in an embodiment, each of the process units Pc through Pf is configured so that an optical density after fixing is at 1.6 when the amount of toner on a transfer material is 0.5 mg/cm$^2$ with respect to each color of Y, MH, CH, and K.

A light color toner and a dark color toner have different color depths in the same hue. That is, a color of the light color toner is lighter than a color of the dark color toner. Note that a colorant of the light color toner can be adjusted so that an optical density is smaller than 1.0 in the unit of an amount of toner on a transfer material at 0.5 mg/cm$^2$, and a colorant of the dark color toner can be adjusted so that an optical density is equal to or greater than 1.0 in the unit of an amount of toner on a transfer material at 0.5 mg/cm$^2$.

In an embodiment, for a development device used for each of the process units, a two-component developer having a nonmagnetic toner and a magnetic carrier is used.

A basic operation of the image forming apparatus is described below. First, an original document placed on an original mount glass (not shown) is scanned to be converted into an electrical signal by a charge-coupled device (CCD) (not shown). The electrical signal is then converted into a digital signal by an A/D conversion device (not shown).

The data converted into a digital signal is processed by an image processing block, and an RGB signal is color-converted into a CMYK signal. Subsequently, the data is gamma-corrected and is then subjected to a lookup table (hereinafter referred to as an "LUT") conversion for dark color toners and light color toners. Then, the data is binarized.

Figure 3:
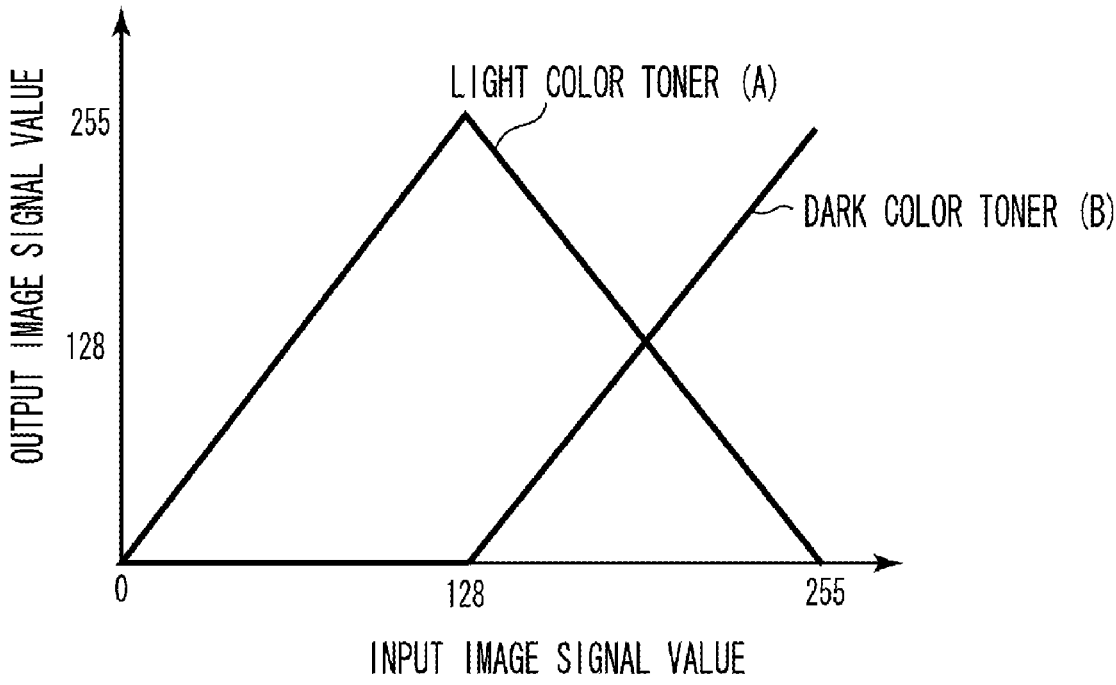
FIG. 3 illustrates an exemplary lookup table for each of light and dark colors according to a conventional method and according to the first exemplary embodiment of the present invention.

FIG. 3 illustrates an example of an LUT for a light color toner (A) and an example of an LUT for a dark color toner (B). The binarized image data is D/A converted after being stored in an image memory (not shown), and then the D/A converted image data is transferred to an exposure driver (not shown). Thus, an exposure apparatus (not shown) is driven to form an image.

Using such light color toner LUT conversion processing, a light color toner is preferentially used in a low density portion of an image signal of a read image. That is, in a low density portion, a density of each dot becomes low. Thus, high granularity in each dot, which is a defect of a binary image, can be lowered. In the present exemplary embodiment, an image is formed using toners having different color depths in the same hue, namely, a light color toner and a dark color toner.

Figure 18:
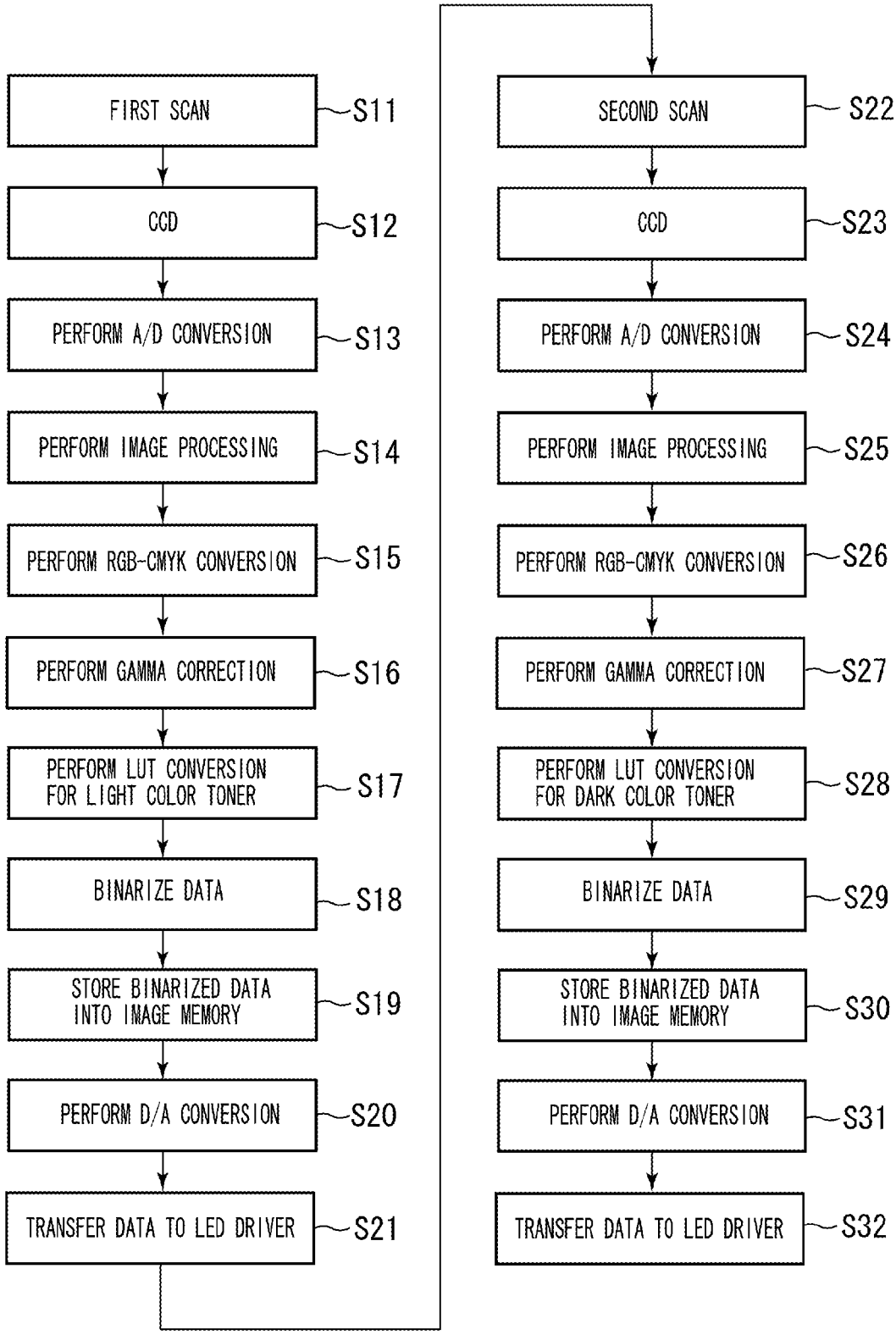
FIG. 18 is a flow chart illustrating a flow of processing of an image signal according to the first exemplary embodiment of the present invention.

Now, a flow of processing of an image signal is described in detail below. FIG. 18 illustrates the flow of an image signal.

In step S11, the image forming apparatus scans an original document placed on an original mount glass (not shown). In step S12, the image forming apparatus converts the read original information into an electrical signal with a charge-coupled device (not shown). In step S13, the image forming apparatus converts the electrical signal into a digital signal using an A/D conversion device (not shown).

In step S14, the image forming apparatus processes the data converted into a digital signal with an image processing block. In step S15, the image forming apparatus an RGB signal into a CMYK signal. Subsequently, in step S16, the image forming apparatus performs gamma correction. Then in step S17, the image forming apparatus performs a light color toner lookup table (LUT) conversion. In step S18, the image forming apparatus binarizes the image data.

In step S19, the image forming apparatus stores the binarized image data into an image memory. In step S20, the image forming apparatus performs a D/A conversion of the image data. In step S21, the image forming apparatus transfers the image data to a light-emitting diode (LED) driver to drive an LED for image formation. Then, a toner image is developed on an electrostatic latent image formed by an LED exposure using the light color toner process units Pa and Pb.

The toner image thus formed is primary-transferred onto an intermediate transfer belt 51 by primary transfer devices 5*a* and 5*b*. As described above, by performing a light color toner LUT conversion, a light color toner is preferentially used in a low density portion of a read image signal. That is, in a low density portion, a density of each dot becomes low. Thus, high granularity in each dot, which is a defect of a binary image, can be lowered. In the present exemplary embodiment, an image is formed using toners having different color depths in the same hue, namely, a light color toner and a dark color toner.

In step S22, the image forming apparatus performs the second scanning of the original document. During the second image forming operation, it is necessary to perform reader-scanning again due to reasons related to the capacity of a memory. In steps S23 through S27, the image forming apparatus processes an image signal in the second scanning just as in the first scanning.

In step S28, the image forming apparatus performs a dark color toner LUT conversion. In step S29, the image forming apparatus binarizes the image data. In step S30, the image forming apparatus stores the binarized data into the image memory. In step S31, the image forming apparatus performs a D/A conversion of the image data. In step S32, the image forming apparatus transfers the image data to the LED driver to drive the LED for image formation. Then, a toner image is developed on an electrostatic latent image formed by an LED exposure using the dark color toner process units Pc through Pf.

The toner image thus formed is primary-transferred onto the intermediate transfer belt 51 by primary transfer devices 5*c* through 5*f*. Then, the image forming apparatus secondary-transfers the toner image onto a transfer material fed from a paper feed cassette using a secondary transfer device. Subsequently, the image forming apparatus fixes the toner image using a fixing device. Then, the image forming apparatus discharges the transfer material.

Around each of the photosensitive drums 1*a*, 1*b*, 1*c*, 1*d*, 1*e*, and 1*f*, the following units and components are disposed in the following order from upstream to downstream along a direction of rotation of the photosensitive drums. First, charge rollers 2*a*, 2*b*, 2*c*, 2*d*, 2*e*, and 2*f*, and exposure devices 3*a*, 3*b*, 3*c*, 3*d*, 3*e*, and 3*f* are disposed. Then, development devices 4*a*, 4*b*, 4*c*, 4*d*, 4*e*, and 4*f* are disposed. Furthermore, primary transfer rollers 5*a*, 5*c*, 5*d*, 5*e*, and 5*f* are disposed. Then, cleaning devices 6*a*, 6*b*, 6*c*, 6*d*, 6*e*, and 6*f* are disposed.

Now, the process units Pa, Pb, Pc, Pd, Pe, and Pf are described with reference to FIG. 2. Note that the six process units Pa, Pb, Pc, Pd, Pe, and Pf have a similar configuration. Accordingly, reference symbols "a", "b", "c", "d", "e", and "f" are omitted to simply refer to the process units as "P" in the following description.

Figure 2:
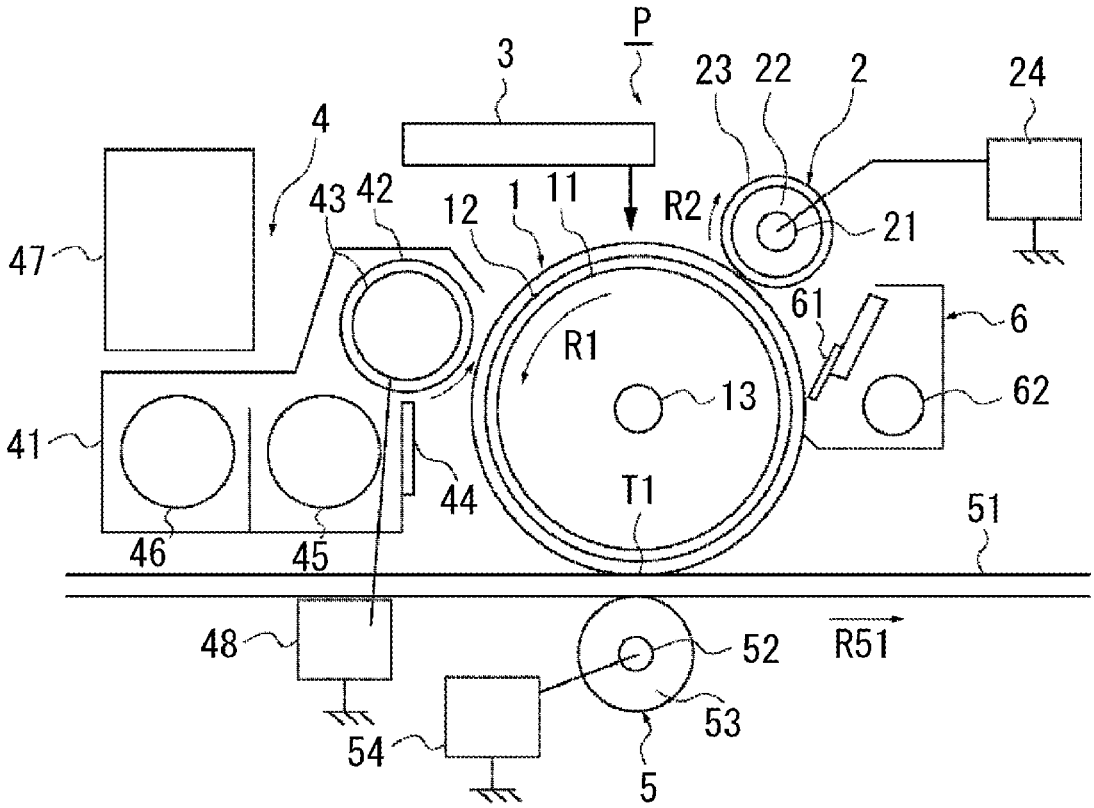
FIG. 2 illustrates an exemplary configuration of components of the image forming apparatus according to the first exemplary embodiment of the present invention.

As illustrated in FIG. 2, the process unit P includes a photosensitive drum 1, which serves as an image bearing member rotatably supported by the image forming apparatus body (not shown). The photosensitive drum 1 basically includes a conductive base body 11 made of aluminum or the like and a photoconductive layer 12 formed around the conductive base body 11, and is an organic photoconductor (OPC) member having a cylindrical shape. In a center portion of the photosensitive drum 1, a spindle 13 is provided so that the photosensitive drum 1 is rotated to be driven at a predetermined process speed (circumferential velocity) by a drive unit (not shown) in a direction indicated by an arrow R1 around the spindle 13.

Above the photosensitive drum 1, a charging roller 2 is disposed. The charging roller 2 contacts the surface of the photosensitive drum 1 to uniformly charge the surface of the photosensitive drum 1 to a predetermined polarity and potential. The charging roller 2 is configured in a roller-like shape.

The charging roller 2 includes a conductive cored bar 21, which is disposed at a center portion of the charging roller 2, a low resistance conductive layer 22, and a medium resistance conductive layer 23. Both end portions of the cored bar 21 are rotatably supported by bearing members (not shown). The charging roller 2 is disposed in parallel to the photosensitive drum 1.

The bearing members disposed at both end portions of the cored bar 21 are urged towards the photosensitive drum 1 by pressure members (not shown). Thus, the charging roller 2 press-contacts the surface of the photosensitive drum 1 at a predetermined level of pressure.

The charging roller 2 is driven to rotate in a direction indicated by an arrow R2 according to the rotation of the photosensitive drum 1 in the direction indicated by the arrow R1. The charging roller 2 is applied with a charging bias voltage by a power source 24. Thus, the charging roller 2 can uniformly contact-charge the surface of the photosensitive drum 1.

At the downstream of the charging roller 2 with respect to the rotational direction of the photosensitive drum 1, an exposure device 3 is disposed. The exposure device 3 scans and exposes the surface of the photosensitive drum 1, which is already charged, while turning on and off a laser beam according to image information, for example. The charging roller 2 removes electric charge in an exposed portion to form an electrostatic image according to the image information.

A development device 4 is disposed at the downstream of the exposure device 3. The development device 4 includes a developer vessel 41 storing therein a two-component developer. In an opening portion of the developer vessel 41 facing the photosensitive drum 1, a development sleeve 42, which serves as a developer bearing member, is rotatably disposed.

In the development sleeve 42, a magnet roller 43, which causes the development sleeve 42 to bear a developer, is fixed and disposed unrotatably with respect to the rotation of the development sleeve 42. Below the development sleeve 42 of the developer vessel 41, a restriction blade 44, which restricts a developer borne on the development sleeve 42 to form a thin developer layer, is disposed.

Furthermore, in the developer vessel 41, a development chamber 45 and a stirring chamber 46 that are mutually partitioned are disposed. Above the developer vessel 41, a replenishment chamber 47 storing a toner to be replenished is disposed. The developer formed into a thin developer layer is carried to a development area facing the photosensitive drum 1, and then rises as an ear due to a magnetic force from a development main pole positioned in a development area of the magnetic roller 43 to form a magnetic brush made of the developer.

By rubbing the surface of the photosensitive drum 1 with the magnetic brush and applying a development bias voltage to the development sleeve 42 with the power source 48, a toner adhering to a carrier forming an ear of the magnetic brush adheres to an exposure portion of an electrostatic latent image to be developed. Thus, a toner image is formed on the photosensitive drum 1.

A primary transfer roller 5 is disposed below the photosensitive drum 1 at the downstream of the development device 4. The primary transfer roller 5 includes a cored bar 52, which is applied with a bias by a power source 54, and a conductive layer 53, which is cylindrically formed on the circumference of the cored bar 52. The primary transfer roller 5 is urged towards the photosensitive drum 1 by pressure members (not shown) such as a spring at both end portions thereof.

Thus, the conductive layer 53 of the primary transfer roller 5 press-contacts the surface of the photosensitive drum 1 at a predetermined pressure level via an intermediate transfer belt 51. Between the photosensitive drum 1 and the intermediate transfer belt 51, a primary transfer portion (a primary transfer nip portion) T1 is formed. In the primary transfer portion T1, the intermediate transfer belt 51 is held and a transfer bias voltage having an inverse polarity to the polarity of a toner is applied by the power source 54. Thus, the toner image on the photosensitive drum 1 is transferred (primary-transferred) onto the surface of the intermediate transfer belt 51.

Adhering matter such as a residual toner on the photosensitive drum 1, after the toner image is transferred to the intermediate transfer belt 51, is removed by a cleaning device 6. The cleaning device 6 includes a cleaner blade 61 and a carrying screw 62. The cleaner blade 61 abuts on the photosensitive drum 1 at a predetermined angle and pressure with pressure unit (not shown) to collect a toner remaining on the surface of the photosensitive drum 1. The collected residual toner is carried and discharged by the carrying screw 62 to be stored in a waste toner box 62.

Referring to FIG. 1, below the photosensitive drums 1*a* through 1*f*, an intermediate transfer unit 59 is disposed. The intermediate transfer unit 59 includes the intermediate transfer belt 51, a drive roller 55, a driven roller 58, a secondary transfer opposing roller 56, the primary transfer rollers 5*a* through 5*f*, on which the intermediate transfer belt 51 is wound, a secondary transfer roller 57, and a belt cleaner 60.

The secondary transfer roller 57 and the secondary transfer opposing roller 56 hold the intermediate transfer belt 51 therebetween. Thus, between the secondary transfer roller 57 and the intermediate transfer belt 51, a secondary transfer portion (a secondary transfer nip portion) T2 is formed.

In the image forming apparatus having the above-described configuration, the toner image of each color, which is formed on the photosensitive drum 1, receives a transfer bias from the primary transfer roller 5 opposing across the intermediate transfer belt 51 in each primary transfer portion T1 and is serially transferred (primary-transferred) onto the intermediate transfer belt 51. Then, the toner image is carried up to the secondary transfer portion T2 as the intermediate transfer belt 51 rotates in the direction indicated by an arrow R51.

A recording material S, which is already stored in a paper feed cassette 8, is fed by a paper feed roller 81 and is conveyed by a conveyance roller 82. The recording material S is supplied by a registration roller 83 to the secondary transfer portion T2 at a predetermined timing, namely, at the same timing as the toner image on the intermediate transfer belt 51.

The toner image is transferred (secondary-transferred) onto the surface of the recording material S in the secondary transfer portion T2 with a secondary transfer bias applied to a portion between the secondary transfer roller 57 and the secondary transfer opposing roller 56. At this time, a toner that is not transferred onto the recording material S and remains on the intermediate transfer belt 51 is removed by the belt cleaner 60 and is collected into the waste toner box 62 as described above.

A fixing device 7 includes a fixing roller 71, which is rotatably disposed, and a pressure roller 72, which rotates while pressure-contacting the fixing roller 71. In the inside of the fixing roller 71, a heater 73 such as a halogen lamp is disposed. By controlling a voltage applied to the heater 73, the temperature of the surface of the fixing roller 71 is adjusted.

In this state, when the recording material is conveyed to the fixing device 7, the fixing roller 71 and the pressure roller 72 rotate at a constant velocity. The recording material S is applied with pressure and heat at a substantially constant pressure and temperature on its front and back surfaces during passing through a portion between the fixing roller 71 and the pressure roller 72. Thus, an unfixed toner image on the surface of the recording material S is melted to be fixed. In this manner, a full color image is formed onto the recording material S.

The intermediate transfer belt 51 is made of a dielectric resin such as PC (polycarbonate), PET (Polyethyleneterephthalate), and PVDF (Polyvinylidenefluoride). In the present exemplary embodiment, a PI resin having a volume resistivity of $10^8$ Ω·cm (using a JIS-K6911-compliant probe: applied voltage: 100V, and voltage application time: 60 sec, 23° C., 50% RH (relative humidity)) and whose thickness is 100 μm is used. However, another material having a different volume resistivity and thickness can be used.

In addition, as shown in FIG. 2, the primary transfer roller 5 includes a cored bar 52 having a diameter of 8 mm and a conductive urethane sponge layer 53 having a thickness of 4 mm surrounding the circumference of the cored bar 52. A resistance of the primary transfer roller 5 can be calculated based on a current measured by rotating the primary transfer roller 5 at a peripheral velocity of 50 mm/sec with respect to grounding under a load of 500 g-weight and applying a voltage of 500 V to the cored bar 52. The resistance was $10^5$Ω (23° C., 50% RH).

Now, a reference patch image and an operation of a density sensor are described.

The image forming apparatus includes a reference image forming unit configured to form a reference image (toner patch image) using predetermined conditions for charging conditions, exposure conditions, development conditions, and transfer conditions with respect to the process units Pa through Pf. The reference image forming unit forms a toner patch image by reading and generating density pattern data, which is stored in a read-only memory (ROM) with a controller thereof.

The toner patch image thus formed is primary-transferred onto the intermediate transfer belt 51. Then, a density sensor 221 (shown in FIG. 4), which is disposed at the upstream of the secondary transfer portion T2 as viewed in the intermediate transfer belt conveyance direction and opposes the intermediate transfer belt 51, detects a density level of the toner patch image.

A unit that performs an operation for detecting a density of a patch image using the reference image forming unit and the density sensor 221 is referred to as a density detection unit.

Figure 4:
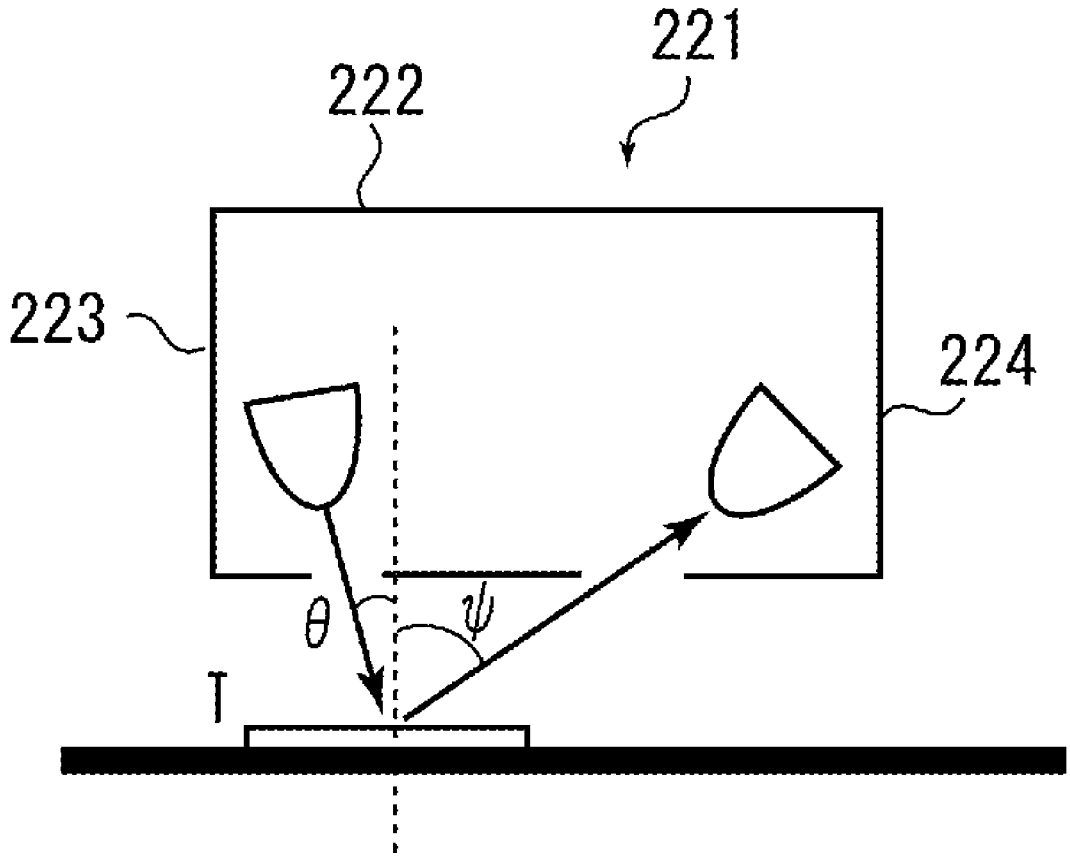
FIG. 4 illustrates a cross section of a diffused light type density sensor according to the first exemplary embodiment of the present invention.

The density sensor 221 includes a light emitting element 223, such as a light-emitting diode (LED), and a light receiving element 224, such as a photo diode or a cadmium sulfide (CdS) sensor, which are incorporated into a holder 222, as illustrated in FIG. 4. The density sensor 221 emits a ray from the light emitting element 223 onto a toner patch image T on the intermediate transfer belt 51 and receives diffused light from the toner patch image T with the light receiving element 224 to detect a density of the toner patch image T.

Reflection light generated when a reference ray is emitted generally includes specular reflection light and diffused light. In the present exemplary embodiment, a diffused light type density sensor is used for the density sensor 221. For the density sensor 221, an incidence angle θ is set to be 15° and a reflection angle ψ is set to be 45°.

Figure 5:
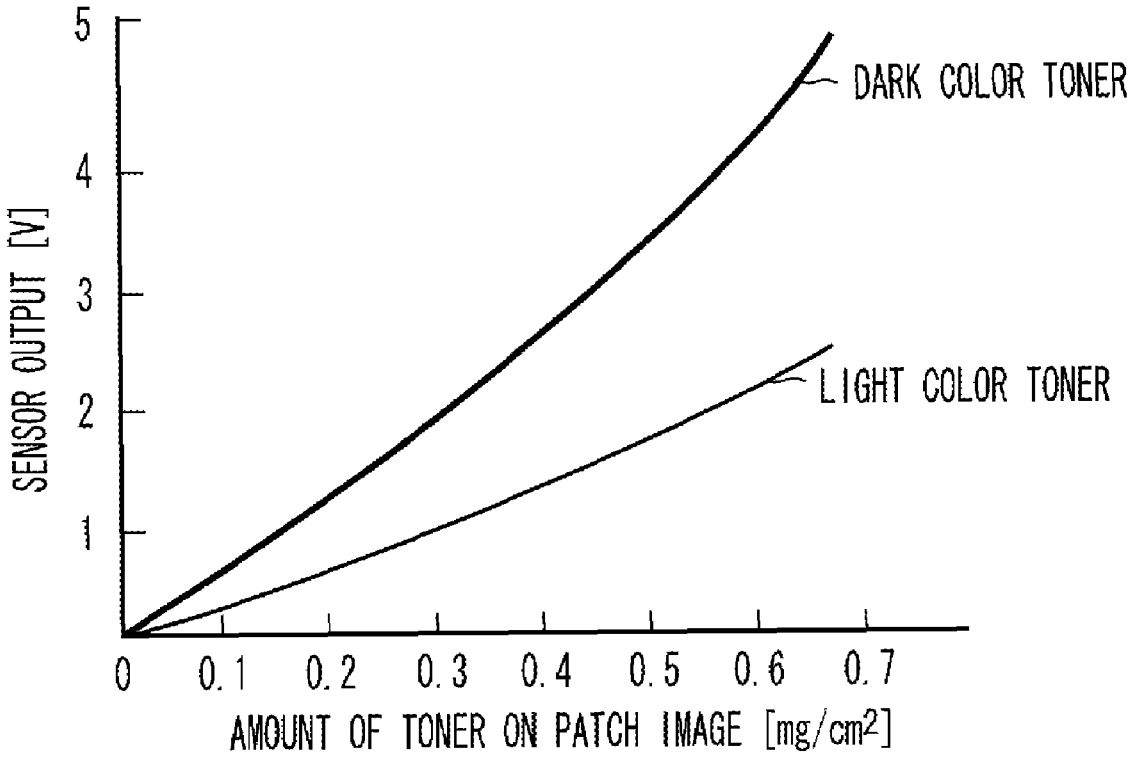
FIG. 5 illustrates outputs of the density sensor relative to the amounts of a light color toner and a dark color toner on a patch image.

FIG. 5 illustrates an output of the density sensor 221 with respect to the amount of a light color toner or a dark color toner on the patch image according to the present exemplary embodiment.

Now, a control operation for replenishment of a toner to a developer according to the present exemplary embodiment is described. In the present exemplary embodiment, a density control apparatus uses a system in which a reference patch image (corresponding to a half tone density) is formed onto the intermediate transfer belt 51 and the density of the formed reference patch image is detected by the density sensor 221, which is disposed opposing the intermediate transfer belt 51. This control system is referred to as patch detection auto toner replenishment (ATR) control.

Thus, in the present exemplary embodiment, it is intended that by controlling the amount of toner replenishment to a development device so that the density of a reference patch image can be made correct, the density of a halftone image, which is subsequently formed, can be made correct.

In the patch detection ATR control, the obtained patch image is illuminated with light emitted from a light emitting unit of a density sensor and reflection light therefrom is received by a light receiving unit such as a photoelectric conversion device to detect an actual density of the patch image.

An output signal obtained as a result of detecting an actual patch image density from the light receiving unit is supplied to one input terminal of a comparator (not shown). In the other input terminal of the comparator, a reference signal corresponding to a predetermined density (initial density) of the patch image is input from a reference voltage signal source.

Figure 6:
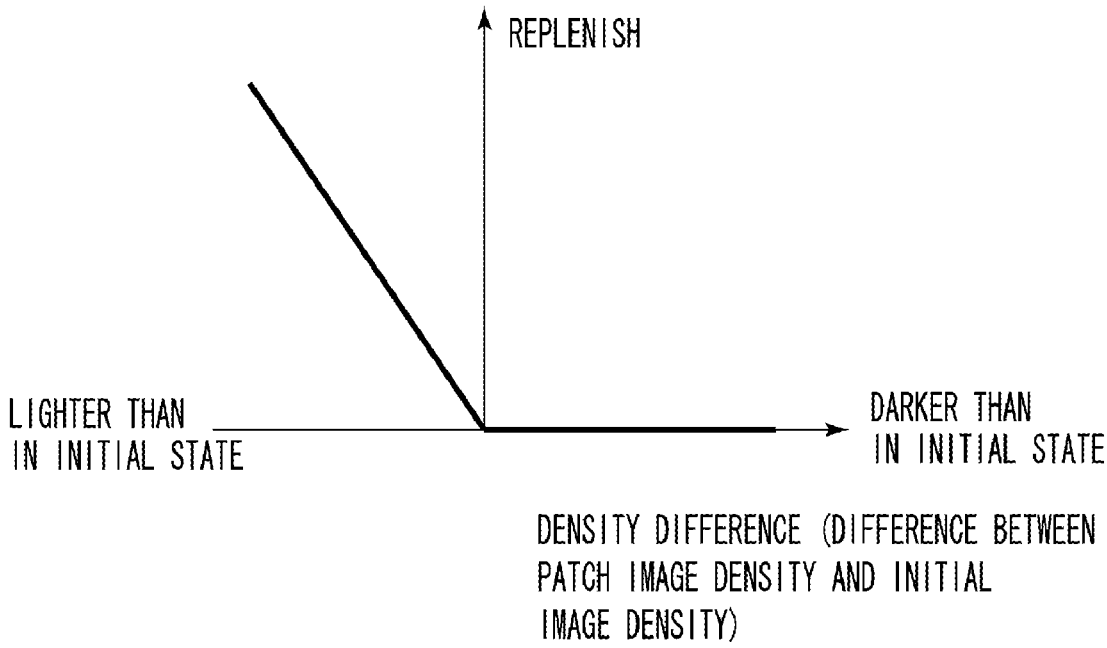
FIG. 6 illustrates a relationship between a result of comparison by a comparator used in a patch detection ATR and the amount of toner replenishment according to the first exemplary embodiment of the present invention.

The comparator compares the patch image density with the initial image density to obtain a density difference, and supplies an output signal indicative of the density difference to a CPU (not shown). Based on the output signal indicative of the density difference, an appropriate amount of toner is replenished from the toner replenishment chamber 47 to a developer in the development device 4, as illustrated in FIG. 6.

The patch detection ATR control significantly depends on a result of detection of the patch image density. Thus, as a frequency of forming a patch image becomes higher, a variation in the toner density can be addressed more quickly. Thus, a more deliberate and correct feed back to the toner replenishment control can be performed. As a result, the toner density can be stabilized.

However, a reference image is wasted without using the toner as a resulting matter. Accordingly, if the frequency of forming a reference image is too high, it is disadvantageous considering running costs.

In this regard, in the present exemplary embodiment, an image forming apparatus capable of stably supplying high quality images while appropriately reducing the amount of toner consumption caused by forming patch images can be provided in the following method.

A method for forming a reference image according to the present exemplary embodiment is described below.

Figure 7A:
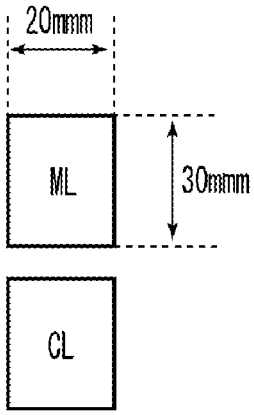
FIG. 7A and FIG. 7B illustrate reference patch image forming modes according to the first exemplary embodiment of the present invention.
Figure 7B:
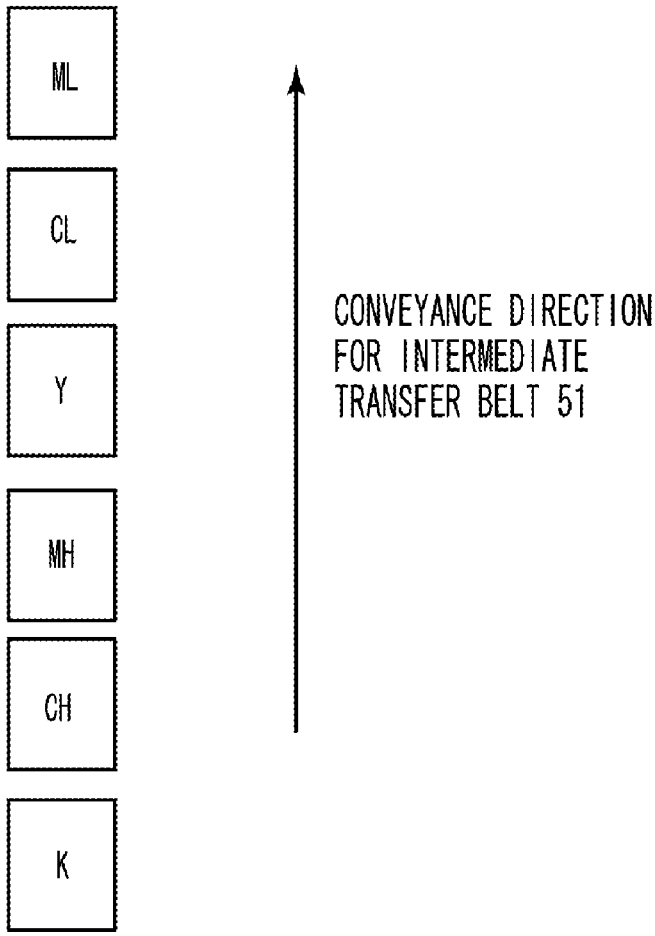

In the present exemplary embodiment, two types of patch forming modes are provided, namely, a mode for forming a reference patch image using two colors of ML (light magenta) and CL (light cyan), and a mode for forming a reference patch image using six colors of ML (light magenta), CL (light cyan), Y (yellow), MH (dark magenta), CH (dark cyan), and K (black), as illustrated in FIG. 7A and FIG. 7B.

The density sensor 221, which opposes the intermediate transfer belt 51, is disposed in a center portion in the longitudinal direction of the intermediate transfer belt 51. In this regard, widths of the reference image are 20 mm and 30 mm in the longitudinal direction and in the conveyance direction, respectively, as illustrated in FIG. 7A and FIG. 7B. Reference images are serially formed for each color.

FIG. 7A illustrates an example of a two-color patch mode in which a reference image is formed using two light colors. In the present exemplary embodiment, the two-color patch mode is operated every five sheets of A4 size paper.

On the other hand, FIG. 7B illustrates an example of a six-color patch mode in which a reference image is formed using six colors. In the present exemplary embodiment, the six-color patch mode is operated every ten sheets of A4 size paper. That is, in the image forming apparatus according to the present exemplary embodiment, in the case of performing image forming while operating development devices for all the six colors, the reference image forming mode for two colors and the reference image forming mode for six colors are alternately repeated every five sheets of A4 size paper.

A flow of the above-described method is described in detail below with reference to the flow chart of FIG. 11.

Figure 11:
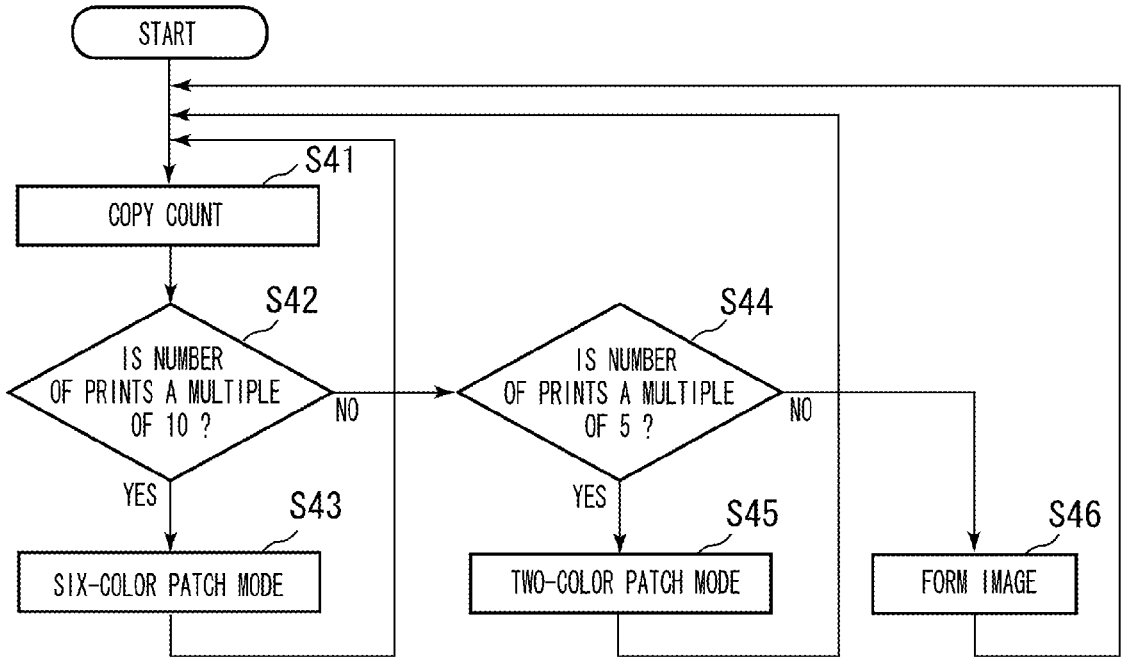
FIG. 11 is a flow chart illustrating a flow of processing for forming a reference patch according to the first exemplary embodiment of the present invention.

Referring to FIG. 11, first, the image forming apparatus starts image forming. When a cumulative counted number of formed images (step S41) is a multiple of 10 in terms of A4 paper (YES in step S42), the image forming apparatus performs the six-color mode reference image forming (see FIG. 7B) (step S43). When a cumulative counted number of formed images is a multiple of 5 (NO in step S42 and YES in step S44), the image forming apparatus performs the two-color mode reference image forming (see FIG. 7A) (step S45). If a cumulative counted number of formed images is not a multiple of 10 or 5 (NO in step S42 and NO in step S44), the image forming apparatus shifts to the next image forming (step S46).

According to the above operation, with respect to each toner of light magenta and light cyan, a reference patch image is formed every five A4-size sheets, and information on the formed reference patch images is fed back to toner replenishment. On the other hand, with respect to each toner of yellow, dark magenta, dark cyan, and black, a reference patch image is formed every ten A4-size sheets, and information on the formed reference patch images is fed back to toner replenishment. Thus, the frequency of forming a reference patch image using the light color toners increases.

As described above, in the patch detection ATR control, the stability of toner density significantly depends on the frequency of forming a reference patch image. On the other hand, as described above, in the present exemplary embodiment, with respect to light magenta and light cyan, a considerably larger amount of toner is consumed than an amount of consumed toner for each of yellow, dark magenta, dark cyan, and black. Accordingly, the toner density is liable to be non-uniform in the developer vessel. That is, if the patch image forming frequency for light magenta and light cyan is the same as the patch image forming frequency of the other toners, a density variation can more easily occur with respect to light color toners.

However, in the present exemplary embodiment, as described above, a mode for forming a patch image using only light color toners (see FIG. 7A) is provided separately from the mode in which patch detection is performed for all the six colors (see FIG. 7B). In an embodiment, the different patch image forming modes are alternatively performed such that the patch image forming frequency for light color toners is twice as high as that of the other toners.

According to an embodiment, with respect to the light color toners, whose consumption amount tends to be large, more patch images are formed and detected so that nonuniformity of the toner density with respect to the light color toners can be prevented to form an image in a stable image density.

On the other hand, with respect to the toners other than the light color toners, an excessively large amount of dark color toners being consumed from forming patch images is prevented from occurring by maintaining the dark color toner patch detection frequency to be at or below a defined level. According to an embodiment, just as in the case of the light color toners, an image using dark color toners can be formed with a stable image density.

In the present exemplary embodiment, values for lightness and density are detected using a spectral densitometer (MODEL: 528) of X-Rite, Incorporated. Further, color values L*, a*, and b* are also detected using the spectral densitometer (MODEL: 528) of X-Rite, Incorporated, under detection conditions of observation light source D50 and observation visual field of 2°.

Now, a method for generating the above-described dark color toners and light color toners is described in detail below.

For cyan colorant for a light cyan toner and dark cyan toner, copper phthalocyanine and its derivative, anthraquinone, and a basic dye lake compound can be used. More specifically, C.I. Pigment Blues 1, 7, 15, 15:1, 15:2, 15:3, 15:4, 60, 62, and 66 are useful.

These colorants and a yellow colorant or a magenta colorant, which are to be described later below, can be mixed to be used as a cyan toner having useful a*, b*, L* values. These colorants can be used in singularity or in combination as a mixture, and in a state of a solid solution.

It is useful that resin components included in a toner have their peak in the range of molecular weight of 600 to 50,000 in a molecular weight distribution by gel permeation chromatography (GPC) of tetrahydrofuran (THF) soluble.

It is useful in controlling the shape of a toner produced by pulverization with heat and mechanical impulsive force that a binder resin used for a toner has its low molecular weight peak in the range of 3,000 to 15,000 in the molecular weight distribution by gel permeation chromatography (GPC).

If the peak for low molecular weight exceeds 15,000, shape factors SF-1 and SF-2 cannot be easily controlled in a useful range, and accordingly, a transfer efficiency cannot be sufficiently improved. If the peak for low molecular weight is less than 3000, fusion is liable to occur during the surface treatment of toner particles.

The shape factors SF-1 and SF-2 are parameters obtained in the following method. That is, first, 100 toner images, each of which is enlarged to 500% using FE-SEM (S-800) of Hitachi, Ltd., are sampled at random.

Then, image information thereof is introduced in an image analysis apparatus (Luzex3 of Nireco Corporation) via an interface for analysis. Then, the parameters are defined based on values computed using the following expressions:

$$SF\text{-}1=\{(MXLNG)^2/\mathrm{AREA}\}\times(\Pi/4)\times 100$$

$$SF\text{-}2=\{(PERI)^2/\mathrm{AREA}\}(\tfrac{1}{4}\Pi)\times 100$$

where

AREA: Projected area of toner,

MXLNG: Absolute maximum length of toner, and

PERI: Peripheral length of toner.

The toner shape factor SF-1 indicates a degree of sphereness of a toner particle, which ranges from a complete sphere to an infinite shape in gradation. The toner shape factor SF-2 indicates a degree of unevenness of a toner particle, which indicates unevenness of a toner surface.

The molecular weight is measured using the GPC. More specifically, in the measuring method with the GPC, a sample that is obtained by previously extracting a toner for twenty hours with tetrahydrofuran (THF) using a Soxhlet extractor is used. For a column structure, A-801, 802, 803, 804, 805, 806, and 807 of Showa Denko Co, Ltd. are joined to each other, and thereby a molecular weight distribution can be measured using a calibration curve made of a standard polystyrene resin.

A resin having a ratio (Mw/Mn) of a weight average molecular weight (Mw) to a number average molecular weight (Mn) in the range of 2 to 100 is useful.

A toner glass transition point (Tg) is useful in the range of 50° C. to 75° C. (alternatively, in the range of 52° C. to 70° C.) considering fixing and storing performance.

For measurement of a glass transition point of a toner, a high-accuracy inner-heat input compensation type differential scanning calorimeter such as DSC-7 of PerkinElmer Co., Ltd., for example, can be used. The method of measurement is compliant to ASTM D3418-82. In the present exemplary embodiment, a DSC curve is used. The DSC curve is measured after the temperature of a test sample is once raised to obtain a previous history and the test sample is rapidly chilled and again temperature-raised at a temperature rise speed of 10° C./min and in a temperature range of 0° C. to 200° C.

The following binder resins can be used in the present exemplary embodiment.

Polystyrene, a substituted styrene homopolymer such as poly-p-chlorostyrene and polyvinyl toluene, a styrene-p-chlorstyrene copolymer, and a styrene-vinyl toluene copolymer.

A Styrene-vinylnaphthalene copolymer, a styrene-acrylic ester copolymer, a styrene-methacrylate ester copolymer, a styrene-α-methyl methacrylate chloride copolymer.

A styrene-acrylonitrile copolymer, a styrene-vinylmethyl ester copolymer, a styrene-vinylethyl ester copolymer, a styrene-vinylmethyl ketone copolymer, a styrene-butadiene copolymer.

A styrene-based copolymer such as a styrene-isoprene copolymer and a styrene-acrylonitrile-indene copolymer.

Polyvinyl chloride, phenol resin, natural denatured phenol resin, natural resin denatured maleic acid resin, acrylic resin, methacrylic resin, poly vinyl acetate, silicone resin, polyester resin, polyurethane, polyamide resin, furan resin, epoxy resin.

Xylene resin, polyvinyl butyral, terpene resin, coumarone-indene resin, and petroleum-based resin. In addition, cross-linked styrene-based resin can be useful as a binder resin.

As a comonomer of a styrene monomer of a styrene-based copolymer, the following can be used.

Acrylic acid, methyl acrylate, ethyl acrylate, butyl acrylate, dodecyl acrylate, octyl acrylate, 2-ethylhexyl acrylate, phenyl acrylate, methacrylate, methyl methacrylate, ethyl methacrylate.

Monocarboxylic acid or substituted monocarboxylic acid having a double bond such as butyl methacrylate, octyl methacrylate, acrylonitrile, methacrylonitrile, acrylamide.

Dicarboxylic acid and substituted dicarboxylic acid having a double bond such as maleic acid, butyl maleate, methyl maleate, dimethyl maleate.

Vinyl monomers such as:

Ethylene-based olefins such as ethylene, propylene, and butyrene; vinyl ketones such as vinylmethyl ketone and vinylhexyl ketone, and Vinyl ethers such as vinylmethyl ether, vinylethyl ether, and vinyl isobutyl ether.

These are used in singularity or in combination.

For a cross-linking agent, a compounds having two or more copolymerizable double bonds described as follows, for example, is used.

An aromatic divinyl compound such as divinyl benzene and divinyl naphthalene.

Carboxylate ester having two double bonds such as ethylene glycol diacrylate, ethylene glycol dimethacrylate, and 1,3-butane diol dimathacrylate.

A divinyl compound such as divinyl aniline, divinyl ether, divinyl sulfide, and divinyl sulfone.

A compound having three or more vinyl groups. These are used in singularity or in combination.

It is useful, considering improvement of mold release characteristics from a fixing member after fixing and fixing characteristics, to include the following waxes in toner particles.

Paraffin wax and its derivative, microcrystalline wax and its derivative, Fischer-Tropsch wax and its derivative, polyolefin wax and its derivative, and carnauba wax and its derivative.

For a derivative, an oxide, a block copolymer with vinyl-based monomer, and a graft modified product can be used.

In addition, long-chain alcohol, a long chain fatty acid, acid amide, an ester wax, ketone, hardened castor oil and its derivative, a vegetable wax, an animal wax, a mineral wax, and petroractum can be used as necessary.

In producing a toner, a binder resin, a wax, a pigment, a dye, or a magnetic substance, and an additive such as a charge control agent, as necessary, are well mixed using a stirring device such as a Henschel mixer and a ball mill. After that, using a heat kneading machine such as a heat roll, a kneader, and an extruder, the resin is melted by melt-mix kneading.

Then, a pigment, a dye, or a magnetic substance is dispersed or melted in the melted resin to solidify by cooling. After that, the solidified resin mixture is pulverized and classified to obtain a toner. In a classifying step, it is useful to use a multiple section sorting apparatus in terms of efficiency of production.

Furthermore, Japanese Patent Publication No. 56-13945 discusses a method in which a spherical toner is obtained by atomizing a melted mixture in the air using a disk or a multi-fluid nozzle. In addition, Japanese Patent Publication No. 36-10231, Japanese Patent Application Laid-Open No. 59-53856, and Japanese Patent Application Laid-Open No. 59-61842 each discuss a method for directly producing a toner using a suspension polymerization method.

Furthermore, a dispersion polymerization method for directly producing a toner using an aqueous organic solvent in which a monomer can be solved and an obtained polymer cannot be solved can be used. Alternatively, toner particles can be manufactured using an emulsion polymerization method, which is typified by a soap-free polymerization method in which a toner is produced by directly polymerizing under a condition in which a water-soluble polar polymerization starting agent exists.

The above-described dark color toner and light color toner have mutually different density levels and hue angles produced by using different colorants. Alternatively, the density level and the hue angle can be made different by using the same colorant in different amounts included in a resin mixture product. In this case, it is useful in setting a density level to set the amount of colorant content for a light color toner to one-fifth or less of the amount of colorant content for a dark color toner.

A carrier used in the present exemplary embodiment is a spherical magnetic particle dispersion type carrier in which magnetic particles are dispersed in a binder resin. Such a carrier can achieve an apparent density or a pressure level of a developer, which is to be described later below.

Now, a carrier is described in detail.

With respect to a carrier, it is useful to use a carrier having a weight average particle diameter of 15 to 60 μm. In an embodiment, a carrier having a weight average particle diameter of 20 to 60 μm is used. In a preferred embodiment, a carrier having a weight average particle diameter of 20 to 45 μm is used. If the weight average particle diameter exceeds 60 μm, evenness of a solid image and reproducibility of fine dots can be lowered. On the other hand, if the weight average particle diameter is less than 15 μm, a carrier for development may possibly adhere to the photosensitive member. Accordingly, in this case, the photosensitive member can be scratched or damaged, which causes degradation of image quality.

In the present exemplary embodiment, the weight average particle diameter of a carrier is measured using a laser diffraction type particle size measurer (of Horiba, Ltd.).

A volume resistivity of the carrier used in the present exemplary embodiment is in the range of $10^9$ to $10^{15}$ Ωcm. If the volume resistivity of the carrier is less than $10^9$ Ωcm, the resistivity is too low, and accordingly, a development area is subjected to a development bias. Thus, a latent image is disturbed. If the volume resistivity of the carrier exceeds $10^{15}$ Ωcm, the carrier itself is charged up. Accordingly, a charging performance for a replenishment toner can be easily lowered.

Figure 8:
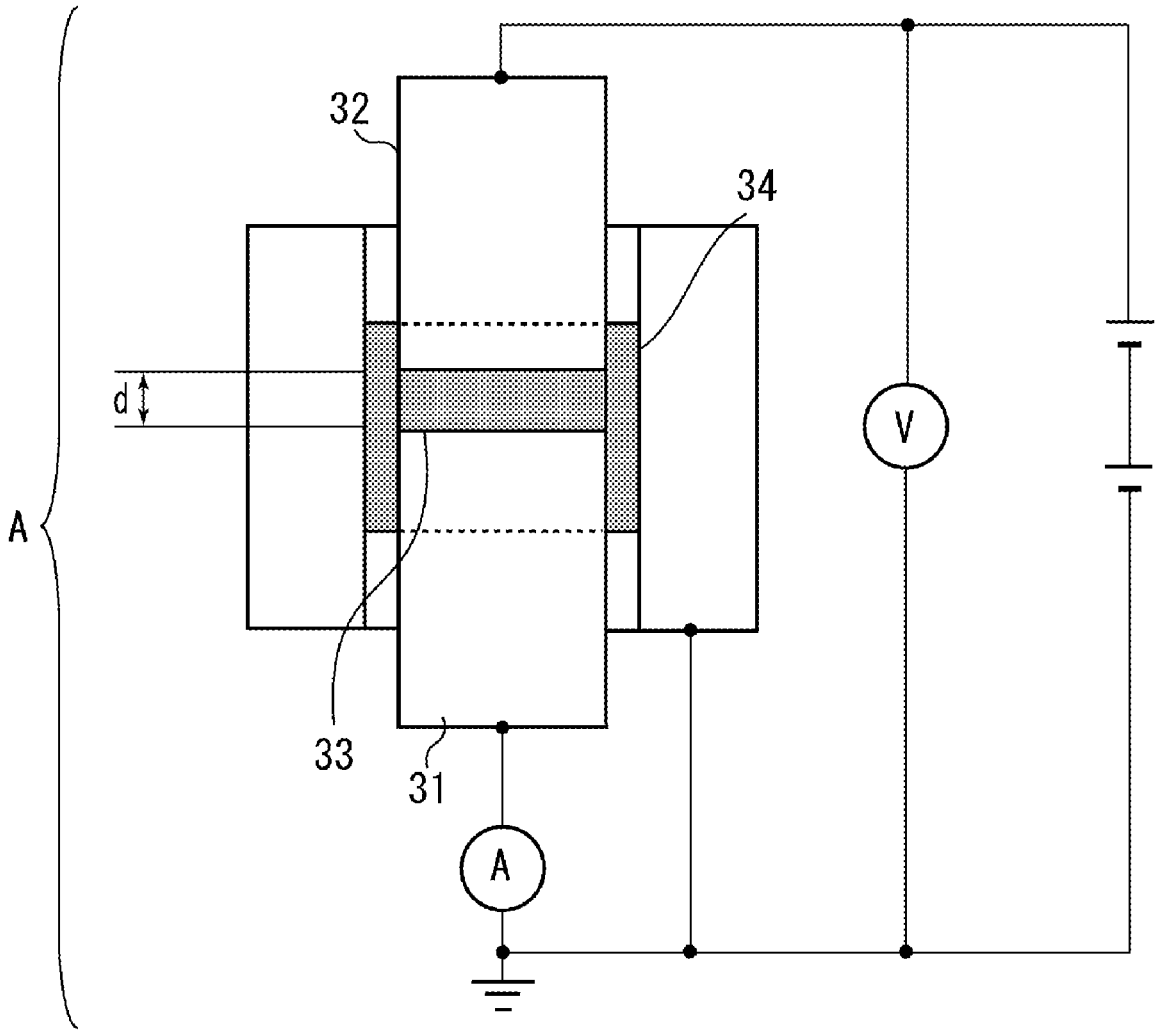
FIG. 8 illustrates a cell used for measuring a volume resistivity of a carrier according to the first exemplary embodiment of the present invention.

A volume resistivity of a magnetic carrier for development is measured using a cell such as the one illustrated in FIG. 8.

Referring to FIG. 8, a sample 33 is filled into a cell A, and a lower electrode 31 and an upper electrode 32 are provided to contact the filled sample 33. In this state, a direct current (DC) voltage is applied between the electrodes 31 and 32 to measure a current flowing at this time using an ammeter. In this measurement, an insulator 34 is used. This measurement is performed under measurement conditions in which a contact area S of the filled sample 33 with the cell is 2 $cm^2$, a thickness "d" of the sample 33 is 3 mm, and a load of the upper electrode 32 is 147 N (15 kg-force).

In the present exemplary embodiment, a two-component developer is prepared by mixing carriers and toners. With respect to a mixture ratio of carriers and toners, a sufficient result can usually be obtained if the toner density in the two-component developer is set to be 1 to 15 percent by mass. It is more useful if the toner density in the two-component developer is set to be 3 to 12 percent by mass. It is far more useful if the toner density in the two-component developer is set to be 5 to 10 percent by mass. If the toner density is less than 1 percent by mass, the image density becomes low. If the toner density exceeds 15 percent by mass, a phenomenon of fog and scatter in a machine increases, which shortens a longevity of the two-component developer.

In the present exemplary embodiment, it is useful if a powder density of the developer is in the range of 1.2 to 2.0 $g/cm^3$. If the powder density is within the above range, even in the case where the particle size of the toner is made small, toner degradation can be reduced. Thus, a variation of the powder density occurring due to embedding of an external additive agent onto the surface of toner particles occurring during endurance can be reduced.

As described above, in the image forming apparatus according to the present exemplary embodiment, during forming of a full color image using six colors, a two-color patch mode in which only light color toners are used to form a reference patch image and a six-color patch mode in which dark color toners and light color toners are used to form a reference patch image are alternately performed.

Accordingly, stable image forming can be performed while providing a high-quality image having reduced granular texture and having a wide color reproduction range without causing a variation in a color tint occurring due to consumption of a large amount of light color toner.

Second Exemplary Embodiment

Now, a second exemplary embodiment of the present invention is described.

The second exemplary embodiment uses an inductance detection ATR control operation (utilizing the magnetic permeability of a developer) including correction for forming a stable reference image with respect to all toners for light magenta, light cyan, yellow, dark magenta, dark cyan, and black. Furthermore, the frequency of forming a reference image with respect to a light color toner is set to be higher than that of a dark color toner. The method according to the second exemplary embodiment is described in detail below.

In the inductance determination ATR control operation, the magnetic permeability of a developer is detected, and based on a result of the detection, a toner is replenished.

As described in the first exemplary embodiment, the replenishment of toner into the development device 4 is controlled to correct a variation in the density of the developer in the development device 4 occurring due to the development of an electrostatic image.

In the second exemplary embodiment, in order to perform the toner replenishment, an actual toner density of the developer in the development chamber 45 is detected based on an output signal from an inductance head (not shown) provided on the bottom wall of the development chamber 45 of each development device 4. In the image forming apparatus according to the second exemplary embodiment, an inductance detection type developer density control apparatus configured to replenish a toner based on a comparison between the result of the detection and a reference value is provided.

As described above, a two-component developer includes a magnetic carrier and a nonmagnetic toner as its primary component. When the toner density of the developer (the ratio of toner weight to the total weight of the carrier and the toner) varies, an apparent magnetic permeability according to a mixture ratio of the magnetic carrier and the nonmagnetic toner varies.

Figure 9:
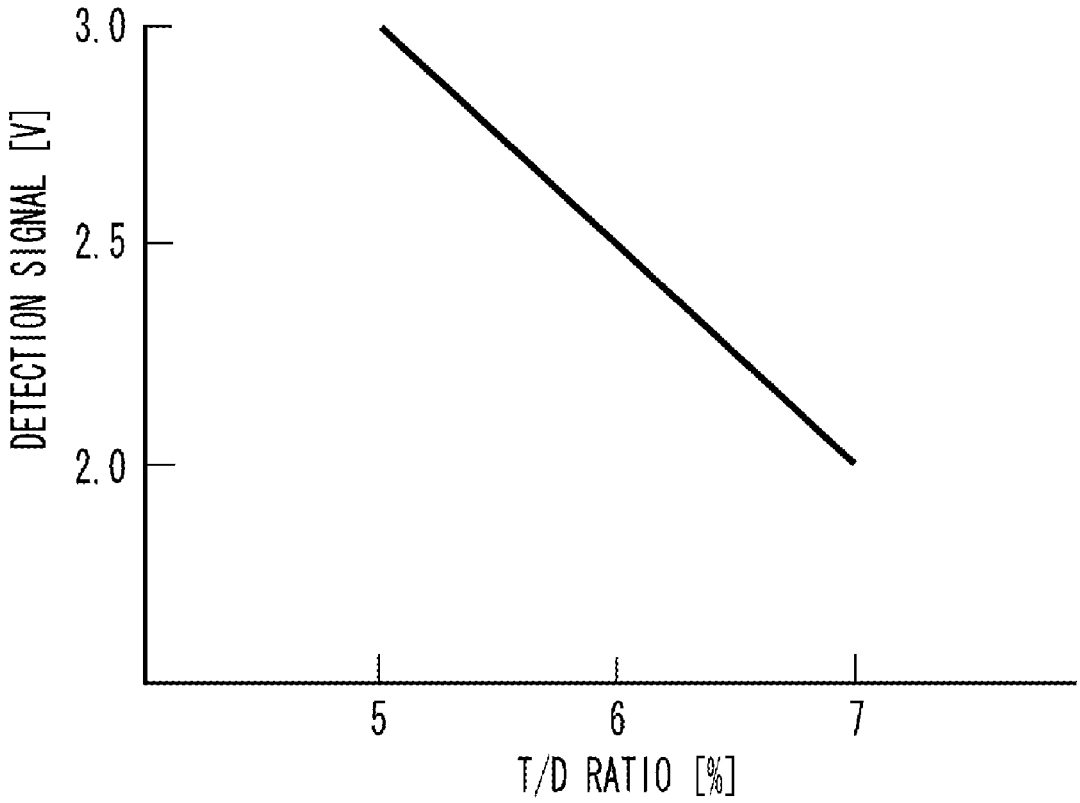
FIG. 9 illustrates a variation of a detection signal output from an inductance head mounted in a development device according to a variation of the toner density of a developer.

When the apparent magnetic permeability is detected by the inductance head and converted into an electrical signal, the electrical signal, namely, a detection signal (V), varies substantially linearly according to the toner density (T/D ratio (%)), as illustrated in FIG. 9.

That is, an output signal from the inductance head corresponds to the actual toner density of the two-component developer in the developer vessel 41. The T/D ratio refers to the weight ratio of a toner in a developer.

An output signal from the inductance head is supplied to one input terminal of a comparator (not shown). In the other input terminal of the comparator, a reference signal corresponding to the apparent magnetic permeability at a predetermined toner density of the developer (an initially set value for the toner density) is input.

Accordingly, the comparator compares the predetermined toner density with the actual toner density of the toner in the developer vessel 41. Thus, a result of the comparison between the input signals, namely, a signal detected by the comparator is supplied to a CPU (not shown).

The CPU controls a toner replenishment time based on the detection signal received from the comparator. For example, if the actual toner density of the developer detected by the inductance head is lower than the predetermined value, that is, if the toner is short of replenishment, the CPU operates the carrying screw of the replenishment chamber 47 so that the toner is replenished to the developer vessel 41 in an amount equivalent to the detected shortage.

More specifically, the CPU computes a screw rotation time necessary for replenishing the toner into the developer vessel 41 in an amount equivalent to the shortage based on the output signal received from the comparator. Then, the CPU rotationally drives a motor for the time period equivalent to the computed screw rotation time by controlling a motor drive circuit to replenish the toner in an amount equivalent to the toner shortage.

If the actual toner density of the developer detected by the inductance head is higher than the predetermined value, that is, if too much toner is replenished, the CPU computes the amount of exceeding toner in the developer based on the detection signal received from the comparator.

In the image forming operation using an original document that is subsequently performed, the CPU controls the toner replenishment so that the exceeding toner does not exist or does not perform the toner replenishment until the exceeding toner is fully consumed. That is, the CPU performs control to form an image without replenishing the toner until the exceeding toner is consumed. When the exceeding toner is fully consumed, the toner is replenished as described above.

The above-described control of the replenishment operation by the CPU is further described below with reference to the flow chart of FIG. 10.

In step S501, the CPU starts the image forming operation. In step S502, the detection of the toner density starts. In step S503, the CPU inputs a detection signal value "a" received from the inductance head into the comparator. In step S504, the CPU causes the comparator to compare the input detection signal value "a" with a reference value "b" output from a reference voltage signal source. In step S505, the comparator sends a voltage difference (a−b) to the CPU. In step S506, the CPU determines whether (a−b)>0.

If it is determined in step S506 that (a−b)>0 (YES in step S506), that is, if the toner density is determined to be lower than the reference value, then in step S507, the CPU determines a toner replenishment time. In step S508, the CPU performs the replenishment of the toner for the determined toner replenishment time. Then, the CPU returns to the start of the toner density detection in step S502.

If it is determined in step S506 that (a−b)≦0 (NO in step S506), that is, if the toner density is equal to or higher than the reference value, the CPU does not perform the replenishment of the toner and returns to the start of the toner density detection in step S502.

In the inductance determination ATR control used in the present exemplary embodiment, the reference value for the detection signal at an optimum toner density is set to be at 2.5 V. If the detection signal received from the sensor is higher than the reference value (for example, 3.0 V), the CPU replenishes the toner. If the detection signal received from the sensor is lower than the reference value (for example, 2.0 V), the CPU suspends the replenishment of the toner.

However, the present exemplary embodiment is not limited to the signal processing described above. That is, the reference value can be of a value other than 2.5 V by changing a configuration of a circuit. Furthermore, the detection signal received from the sensor can be lowered if the toner density is lower than the reference value and can be made to be higher when the toner density is higher than an optimum value.

An optimum toner density according to the present exemplary embodiment is 6%. If the toner density is extremely higher than 6%, the toner is scattered in the image forming apparatus. On the other hand, if the toner density is extremely lower than 6%, the image density becomes very low.

In the present extremely embodiment, using the inductance detection control described above, an affect from charge-up of the toner occurring in a low humidity environment and charge-down of the toner occurring due to a long-time neglect can be suppressed by the following method.

Figure 10:
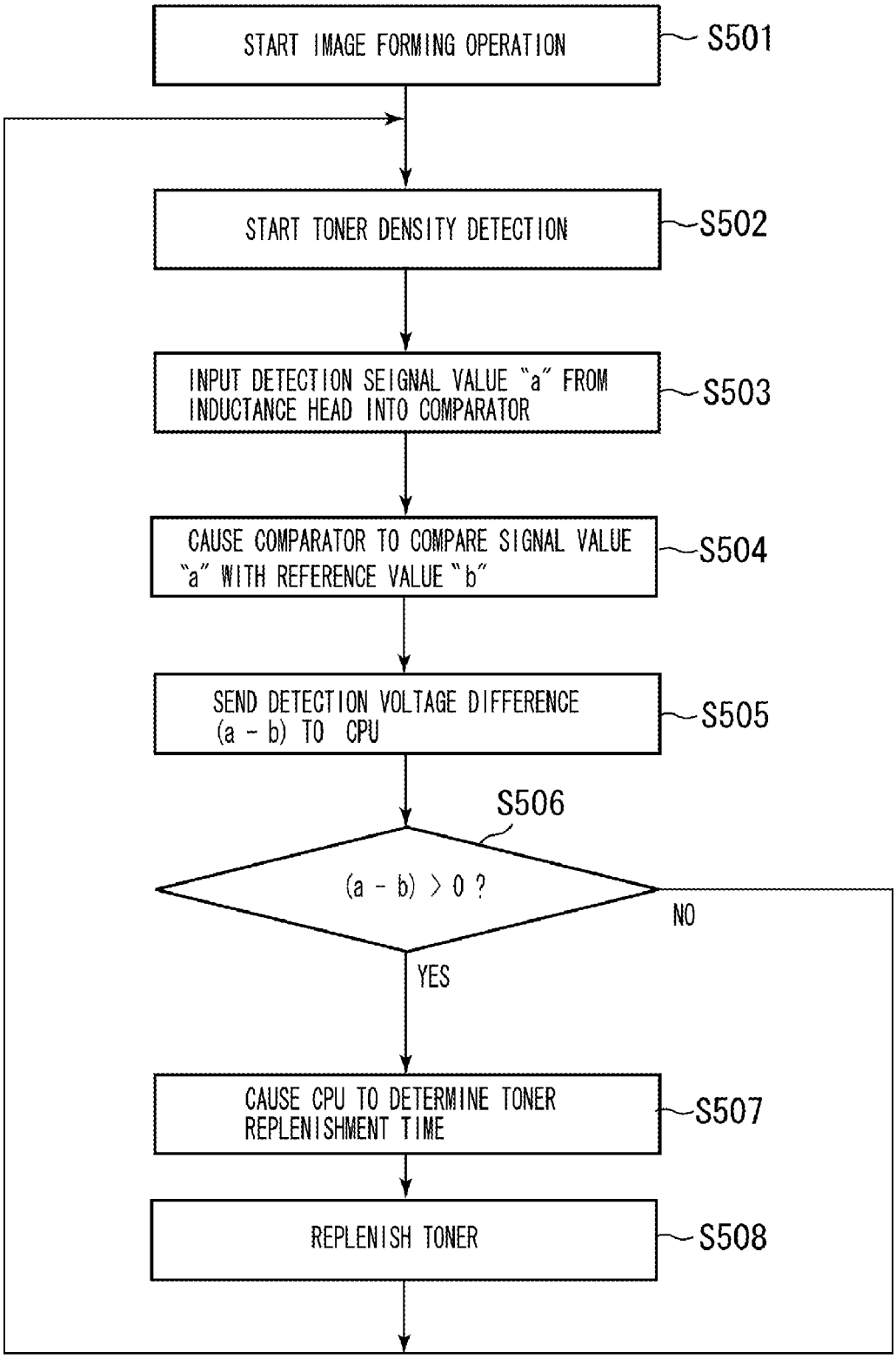
FIG. 10 is a flow chart illustrating a toner replenishment control operation using an inductance detection method according to a second exemplary embodiment of the present invention.

That is, a reference patch image is formed as necessary, and based on a result of comparison between the formed reference patch image and a reference patch image formed using an initialization agent, the CPU corrects the reference value "b" illustrated in FIG. 10 so that the reference patch image density becomes constant. Thus, in the second exemplary embodiment, during the inductance detection replenishment control, the CPU performs the toner replenishment control using the result of the detection of the reference patch image.

As described above, the consumption amount of a light color toner is naturally large. Accordingly, the toner density of the light color toner in the developer vessel is liable to be nonuniform due to the large toner consumption. As a result, the toner charge amount varies at the same time, and thus the image density varies.

In addition, with an affect from the charge-up of the toner occurring under a low-humidity environment and the charge-down of the toner occurring due to a long-time neglect, the toner density and the image density more considerably vary with respect to the light color toner than in the case of the other toners whose consumption amount is relatively low.

In this regard, in the present exemplary embodiment, the frequency of forming a reference image for the light color toner is made higher than that for the dark color toner. This method is described below with reference to FIG. 12.

Figure 12:
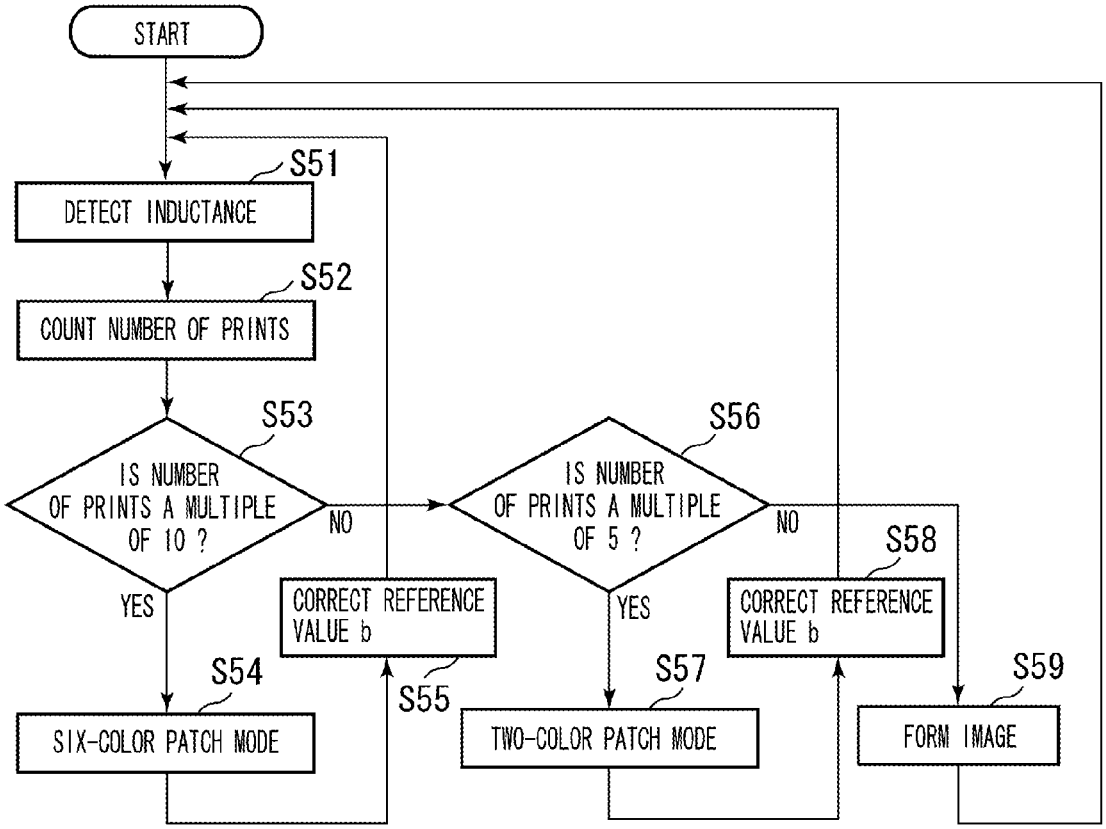
FIG. 12 is a flow chart illustrating a flow of processing for forming a reference patch according to the second exemplary embodiment of the present invention.
Figure 13:
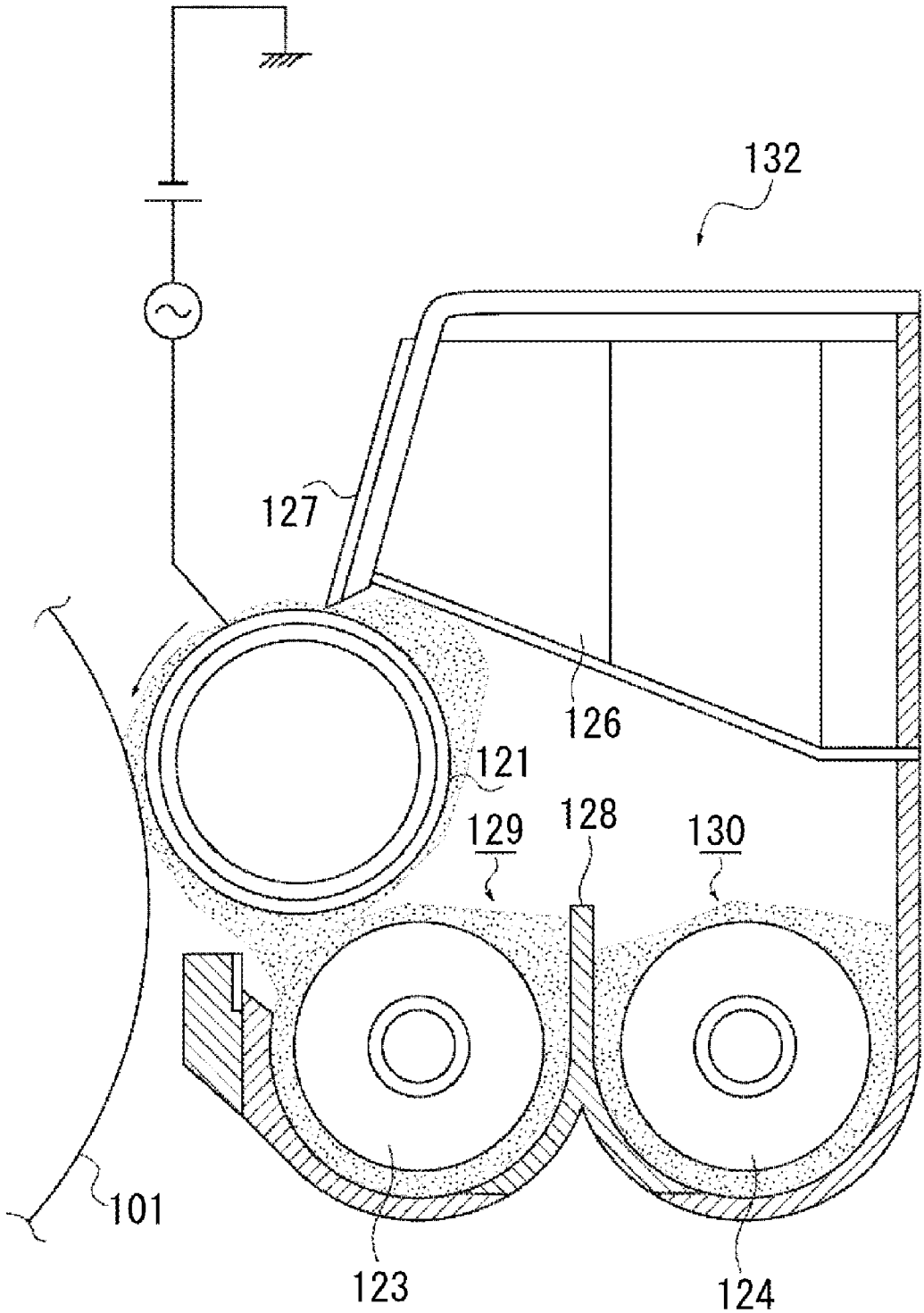
FIG. 13 illustrates a cross section of a conventional development device.
Figure 14:
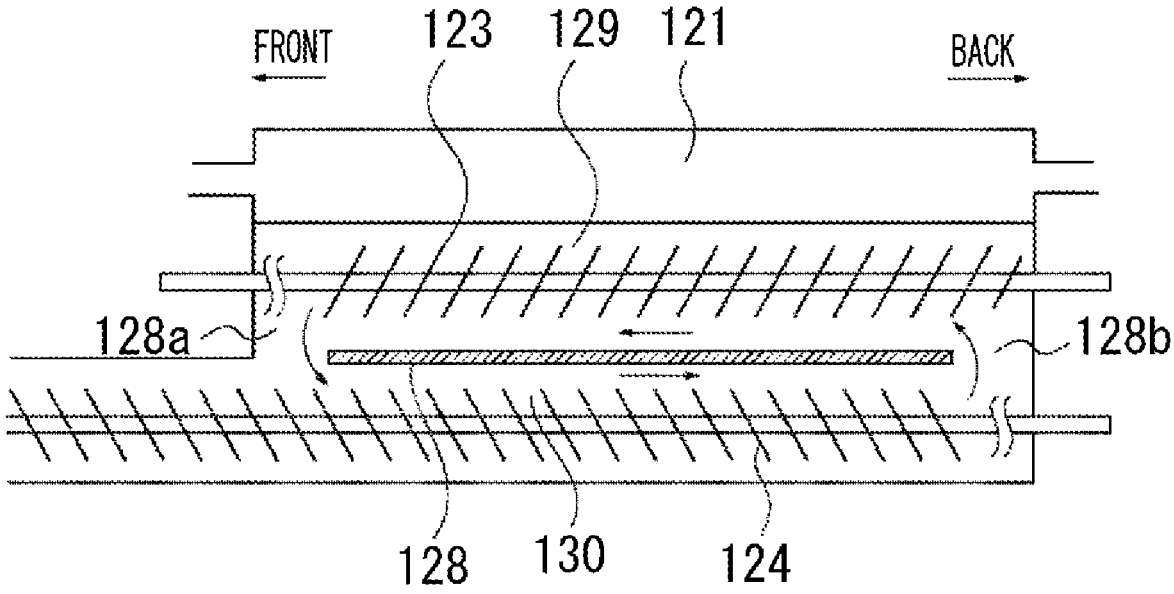
FIG. 14 is a top view of the conventional development device.

Referring to the flow chart of FIG. 12, first, the image forming apparatus starts image forming. Then, the image forming apparatus performs the inductance detection (step S51). When a cumulative counted number of formed images is a multiple of 10 in terms of A4 paper (YES in step S53), the image forming apparatus performs the six-color mode reference image forming (see FIG. 7B) (step S54). When a cumulative counted number of formed images is a multiple of 5 (NO in step S53 and YES in step S56), the image forming apparatus performs the two-color mode reference image forming (see FIG. 7A) (step S57). If a cumulative counted number of formed images is not a multiple of 10 or a multiple of 5 (NO in step S53 and NO in step S56), the CPU shifts to the next image forming (step S59).

According to the above operation, with respect to each toner of light magenta and light cyan, a reference patch image is formed every five A4-size sheets, and information on the formed reference patch images is fed back to the reference value "b" (step S55), which is a target value in the inductance detection control. On the other hand, with respect to each toner for yellow, dark magenta, dark cyan, and black, a reference patch image is formed every ten A4-size sheets, and information on the formed reference patch images is fed back to the reference value "b" (step S58), which is a target value in the inductance detection control. Thus, the frequency of forming a reference patch image for the light color toners increases.

As described above, in the case of using the inductance detection ATR control, the toner density stability considering an affect from charge-up and charge-down of the toner significantly depends on the frequency of forming a reference patch image.

As described above, in the present exemplary embodiment, with respect to light magenta and light cyan, a considerably larger amount of toner is consumed than an amount of consumed toner for each of yellow, dark magenta, dark cyan, and black. Accordingly, the toner density is liable to be nonuniform in the developer vessel. That is, if the reference image forming frequency for light magenta and light cyan is the same as the patch image forming frequency of the other toners, a density variation can more easily occur with respect to light color toners.

However, in the present exemplary embodiment, as described above, a mode for forming a patch image using only light color toners (see FIG. 7A) is provided separately from the mode in which patch detection is performed for all the six colors (see FIG. 7B). By alternately performing the different patch image forming modes, the patch image forming frequency for light color toners is twice as higher than that of the other toners. Thus, with respect to the light color toners, whose consumption amount is naturally large, an appropriate inductance target value according to the state of the toner can be selected. Accordingly, nonuniformity of the toner density can be prevented to form an image in a stable image density.

On the other hand, with respect to the toners other than the light color toners, it is prevented to consume an extremely large amount of toners occurring when too many patch images are formed, and the patch detection frequency can be maintained to be at a necessary and sufficient level. Thus, just as in the case of the light color toners, an image can be formed with a stable image density.

For the method of detecting the toner density, there are various methods such as developer-contacting type optical detection and developer non-contacting type optical detection, in addition to the above-described method using an inductance sensor. The toner density can be detected using any proper method.

As described above, in the image forming apparatus according to the present exemplary embodiment, the inductance detection ATR control is performed on the toners having different color depths in the same hue while correcting the image density so that the reference image density can be constant.

In addition, during forming of a full color image using six colors, a two-color patch mode in which only light color toners are used to form a reference patch image and a six-color patch mode in which dark color toners and light color toners are used to form a reference patch image are alternately performed.

Accordingly, stable image forming can be performed while providing a high-quality image having no granular texture and having a wide color reproduction range without causing a variation in a color tint occurring due to consumption of a large amount of toner.

Third Exemplary Embodiment

Now, a third exemplary embodiment of the present invention is described below.

In the third exemplary embodiment, in addition to employing the patch detection ATR control of the developers for four colors of yellow, dark magenta, dark cyan, and black, a transparent toner developer is provided as the fifth color, and the patch detection ATR control is also employed in the toner replenishment control of the transparent toner developer.

The frequency of forming a reference image for a transparent toner development device is set to be higher than that of each of the development devices for the other color toners. The patch detection ATR control employed in the third exemplary embodiment is similar to that described in the first exemplary embodiment. Accordingly, a description thereof is not repeated here.

In the present exemplary embodiment, the process unit Pa illustrated in FIG. 1 is dismounted, and a process unit loaded with a developer including a transparent toner is provided in place of the process unit Pb. In the process units Pc through Pf, process units loaded with developers in order of yellow, dark magenta, dark cyan, and black are arranged.

The transparent toner is used to achieve uniform image glossiness for the entire image (the entire surface of a recording material) by reducing a difference of glossiness between the glossiness in an image area and the glossiness in a non-image area. Furthermore, the transparent toner is used to improve the glossiness for the entire image by reducing and moderating unevenness of the surface of a recording material. Moreover, the transparent toner can be used to prevent cracking and tear of the toner image melted to be fixed onto the recording material occurring when the recording material is bent or scratched.

In order to achieve these intentions, a white color toner can be used in addition to or instead of the transparent toner.

In the present exemplary embodiment, as described above, the patch detection ATR control method is employed for the developer toner replenishment control of five colors of transparent toner, yellow, dark magenta, dark cyan, and black. The frequency of forming a reference image for the transparent toner is set higher than the frequency of forming a reference image for the other color toners. This method is described below in detail.

Figure 15A:
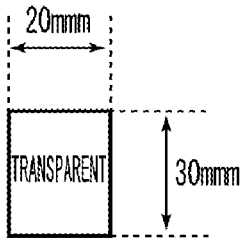
FIG. 15A and FIG. 15B illustrate reference patch forming modes according to a third exemplary embodiment of the present invention.
Figure 15B:
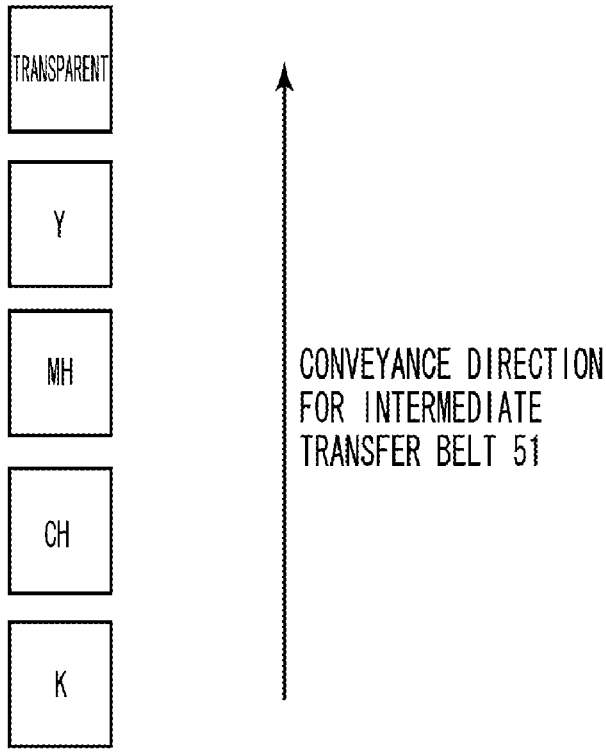

In the present exemplary embodiment, two types of patch forming modes, namely, a mode in which a reference patch image is formed using only one color of transparent toner and a mode in which a reference patch image is formed using five colors of transparent toner, Y, MH, CH, and K are provided, as illustrated in FIG. 15A and FIG. 15B.

The density sensor 221, which opposes the intermediate transfer belt 51, is disposed in a center portion in the longitudinal direction of the intermediate transfer belt 51. In this regard, widths of the reference image are 20 mm and 30 mm in the longitudinal direction and in the conveyance direction, respectively, as illustrated in FIG. 15A and FIG. 15B. Reference images are serially formed for each color.

FIG. 15A illustrates an example of a one-color patch mode in which a reference image is formed using only one color of transparent toner. In the present exemplary embodiment, the one-color patch mode is operated every five sheets of A4 size paper.

On the other hand, FIG. 15B illustrates an example of a five-color patch mode in which a reference image is formed using five colors. In the present exemplary embodiment, the five-color patch mode is operated every ten sheets of A4 size paper.

That is, in the image forming apparatus according to the present exemplary embodiment, in the case of performing image forming while operating development devices for all the five colors, the reference image forming mode for one color and the reference image forming mode for five colors are alternately repeated every five sheets of A4 size paper.

A flow of the above-described method is described in detail below with reference to the flow chart of FIG. 16.

Figure 16:
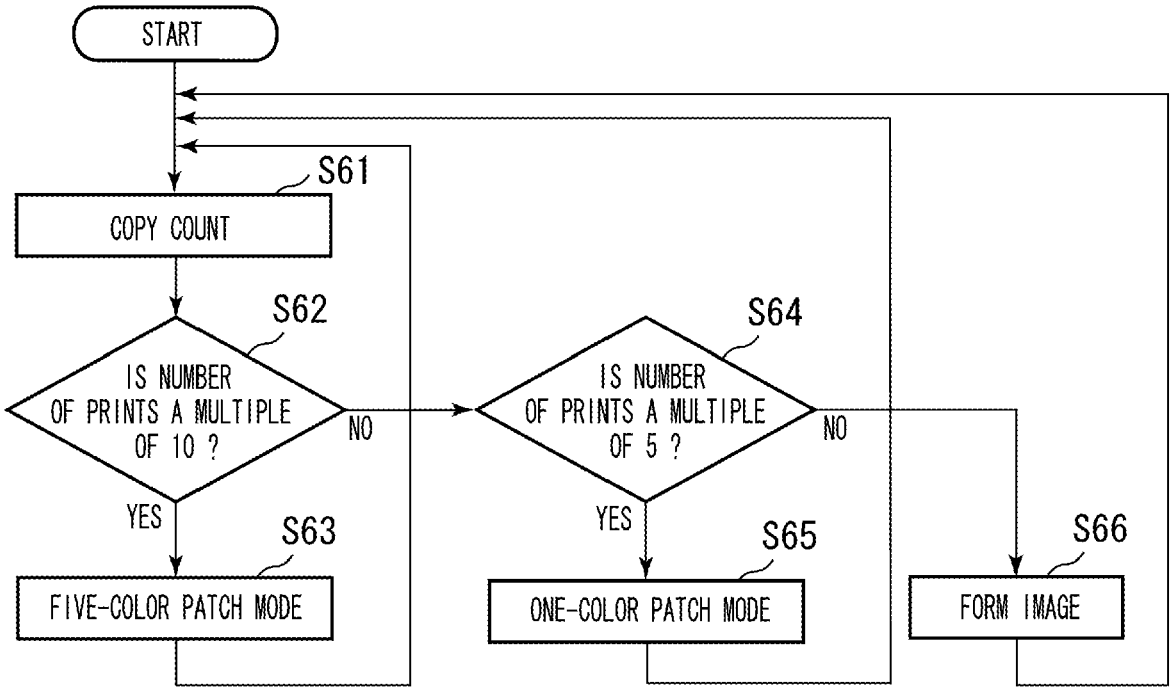
FIG. 16 is a flow chart illustrating a flow of processing for forming a reference patch according to a third exemplary embodiment of the present invention.

Referring to FIG. 16, first, the image forming apparatus starts image forming. When a cumulative counted number of formed images (step S61) is a multiple of 10 in terms of A4 paper (YES in step S62), the image forming apparatus performs the five-color mode reference image forming (see FIG. 15B) (step S63).

When a cumulative counted number of formed images is a multiple of five (NO in step S62 and YES in step S64), the image forming apparatus performs the one-color mode reference image forming (see FIG. 15A) (step S65). If a cumulative counted number of formed images is not a multiple of 10 or 5 (NO in step S62 and NO in step S64), the image forming apparatus shifts to the next image forming (step S66).

According to the above operation, with respect to the transparent toner, a reference patch is formed every five A4-size sheets, and information on the formed reference patch images is fed back to toner replenishment.

On the other hand, with respect to each toner for yellow, dark magenta, dark cyan, and black, a reference image is formed every ten A4-size sheets, and information on the formed reference patch images is fed back to toner replenishment. Thus, the frequency of forming a reference patch image for the transparent color toner increases.

As described above, in the patch detection ATR control, the stability of toner density significantly depends on the frequency of forming a reference patch image.

On the other hand, as described above, in the present exemplary embodiment, with respect to the transparent toner, a considerably larger amount of toner is consumed than an amount of consumed toner for each of yellow, dark magenta, dark cyan, and black. Accordingly, the toner density is liable to be nonuniform in the developer vessel. That is, if the patch image forming frequency for the transparent toner is the same as the patch image forming frequency of the other toners, a density variation can more easily occur with respect to the light color toner.

However, in the present exemplary embodiment, as described above, a mode for forming a patch image using only the transparent toner (see FIG. 15A) is provided separately from the mode in which patch detection is performed for all the five colors (see FIG. 15B). By alternately performing the different patch image forming modes, the patch image forming frequency for the transparent toner is twice as high as that of the other toners.

Thus, with respect to the transparent toner, whose consumption amount is naturally large, more patch images are formed so that nonuniformity of the toner density can be prevented to form an image in a stable image density.

On the other hand, with respect to the toners other than the transparent toner, it is prevented to consume an extremely large amount of toners occurring when too many patch images are formed. Thus, just as in the case of the transparent toner, an image can be formed with a stable image density.

The transparent toner in the present exemplary embodiment includes colorless toner particles not including coloring materials and agents intended to apply color by light absorption and light scattering (such as a coloring pigment, a coloring dye, a black carbon particle, and black magnetic powder), and includes at least a binder resin.

Furthermore, the transparent toner in the present exemplary embodiment is basically colorless and transparent. However, depending on the kind and amount of a superplasticizer and a mold release agent included therein, a degree of transparency can be lowered to some extent, but the transparent toner is substantially colorless and transparent.

For the above-described binder resin, a binder resin substantially transparent can be used, and can be selected according to the purpose of use. For example, following resins can be used.

Polyester-based resin, polystyrene-based resin, polyacrylic resin, and other vinyl-based resin.

A resin used for a general toner such as polycarbonate resin, polyamide-based resin, polyimide-based resin, epoxy-based resin, polyurea-based resin, and their copolymer. Of these resins, a polyester-based resin is useful considering that toner characteristics such as a low-temperature fixing performance, fixing strength, and preservation performance can be satisfied at the same time.

A resin used for the transparent toner itself is transparent. However, when the resin takes a form of particles as a toner, the transparent toner can be recognized as white, due to irregular light reflection. Accordingly, in forming a patch image, due to the irregular light reflection, the amount of toner on the patch image can be detected by a sensor.

As described above, in the image forming apparatus according to the present exemplary embodiment, during forming of a full color image using five colors, a one-color patch mode in which only a transparent toner is used to form a reference patch image and a five-color patch mode in which all color toners are used to form a reference patch image are alternately performed. Accordingly, stable image forming can be performed while providing a high-quality image having uniform glossiness without causing a variation in glossiness occurring due to consumption of a large amount of transparent toner.

Fourth Exemplary Embodiment

Now, a forth exemplary embodiment of the present invention is described below.

In the fourth exemplary embodiment, in addition to employing the patch detection ATR control of the developers for four colors of yellow, dark magenta, dark cyan, and black, a light black toner (KL) developer is provided as the fifth color, and a transparent toner developer is provided as the sixth color. The patch detection ATR control is also employed in the toner replenishment control of the light black toner developer and the transparent toner developer.

The frequency of forming a reference image for a transparent toner and a light black toner is set to be higher than that of each of the development devices for the other color toners. The patch detection ATR control employed in the third exemplary embodiment is similar to that described in the first exemplary embodiment. Accordingly, a description thereof is not repeated here.

In the present exemplary embodiment, a process unit loaded with a developer including a transparent toner is provided in place of the process unit Pa illustrated in FIG. 1, and a process unit loaded with a developer including a light black toner is provided in place of the process unit Pb. In the process units Pc through Pf, process unit loaded with developers in order of yellow, dark magenta, dark cyan, and black are arranged.

The present exemplary embodiment includes the following modes as image forming modes in which the operation is performed on five or more colors.

A mode using five colors of yellow, dark magenta, dark cyan, black, and light black.

A mode using six colors of yellow, dark magenta, dark cyan, black, light black, and transparent toner.

A mode using five colors of yellow, dark magenta, dark cyan, black, and transparent toner.

In the present exemplary embodiment, as described above, the patch detection ATR control is employed for the developer toner replenishment control of six colors of transparent toner, light black, yellow, dark magenta, dark cyan, and black.

The frequency of forming a reference image for the transparent toner and the light black toner is set higher than the frequency of forming a reference image for the other color toners. This method is described below in detail.

The present exemplary embodiment is described below referring to an example in which the six-color mode using six colors of transparent toner, light black, yellow, dark magenta, dark cyan, and black. However, the following description can also apply to the above-described two kinds of five-color modes.

Figure 17A:
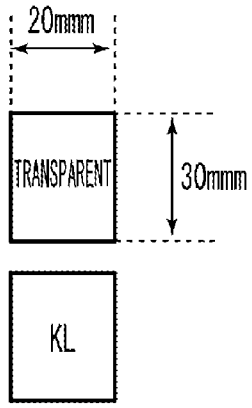
FIG. 17A and FIG. 17B illustrate reference patch forming modes according to a fourth exemplary embodiment of the present invention.
Figure 17B:
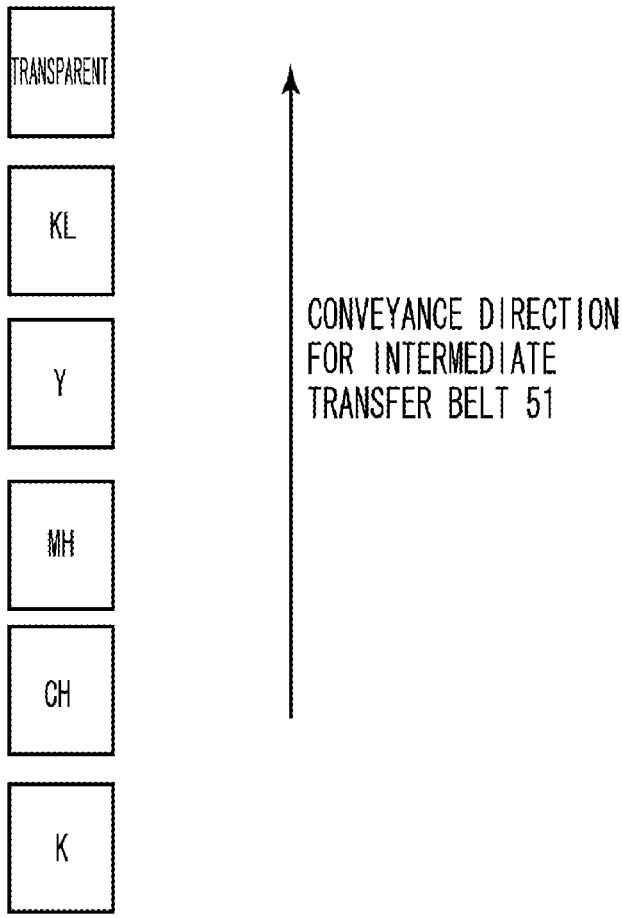

In the present exemplary embodiment, two kinds of patch forming modes, namely, a mode in which a reference patch image is formed using two colors of transparent toner and light black toner and a mode in which a reference patch image is formed using six colors of transparent toner, light black toner, Y, MH, CH, and K are provided, as illustrated in FIG. 17A and FIG. 17B.

The density sensor 221, which opposes the intermediate transfer belt 51, is disposed in a center portion in the longitudinal direction of the intermediate transfer belt 51. In this regard, widths of the reference image are 20 mm and 30 mm in the longitudinal direction and in of the intermediate transfer belt 51 direction, respectively, as illustrated in FIG. 17A and FIG. 17B. Reference images are serially formed for each color.

FIG. 17A illustrates an example of a two-color patch mode in which a reference image is formed using two colors of transparent toner and light black. In the present exemplary embodiment, the two-color patch mode is operated every five sheets of A4 size paper.

On the other hand, FIG. 17B illustrates an example of a six-color patch mode in which a reference image is formed using six colors. In the present exemplary embodiment, the six-color patch mode is operated every ten sheets of A4 size paper. That is, in the image forming apparatus according to the present exemplary embodiment, in the case of performing image forming while operating development devices for all the six colors, the reference image forming mode for two colors and the reference image forming mode for six colors are alternately repeated every five sheets of A4 size paper.

A flow of the above-described method is described in detail below with reference to the flow chart of FIG. 11.

Referring to FIG. 11, first, the image forming apparatus starts image forming. When a cumulative counted number of formed images (step S41) is a multiple of 10 in terms of A4 paper, the image forming apparatus performs the six-color mode reference image forming (see FIG. 17B) (step S43). When a cumulative counted number of formed images is a multiple of 5, instead of being a multiple of ten (NO in step S42 and YES in step S44), the image forming apparatus performs the two-color mode reference image forming (see FIG. 17A) (step S45). If a cumulative counted number of formed images is not a multiple of 10 or 5 (NO in step S42 and NO in step S44), the image forming apparatus shifts to the next image forming (step S46).

According to the above operation, with respect to each toner of the transparent toner and the light black toner, a reference patch image is formed every five A4-size sheets, and information on the formed reference patch images is fed back to toner replenishment.

On the other hand, with respect to each toner for the transparent toner, light black, yellow, dark magenta, dark cyan, and black, a reference patch image is formed every ten A4-size sheets, and information on the formed reference patch images is fed back to toner replenishment. Thus, the frequency of forming a reference patch image for the transparent toner and the light black toner increases.

As described above, in the patch detection ATR control, the stability of toner density significantly depends on the frequency of forming a reference patch image.

On the other hand, as described above, in the present exemplary embodiment, with respect to the transparent toner and the light black toner, a considerably larger amount of toner is consumed than an amount of consumed toner for each of yellow, dark magenta, dark cyan, and black. Accordingly, the toner density is liable to be nonuniform in the developer vessel. That is, if the patch image forming frequency for the transparent toner and the light black toner is the same as the patch image forming frequency of the other toners, a density variation can more easily occur with respect to the transparent toner and the light black toner.

However, in the present exemplary embodiment, as described above, a mode for forming a patch image using only the transparent toner and dark black (see FIG. 17A) is provided separately from the mode in which patch detection is performed for all the six colors (see FIG. 17B). By alternately performing the different patch image forming modes, the patch image forming frequency for the transparent toner and the light black toner is twice as high as that of the other toners.

Thus, with respect to the transparent toner and the light black toner, whose consumption amount is naturally large, more patch images are formed so that nonuniformity of the toner density can be prevented to form an image in a stable image density.

On the other hand, with respect to the toners other than the transparent toner and the light black toner, it is prevented to consume an extremely large amount of toners occurring when too many patch images are formed, and the patch detection frequency can be maintained to be at a necessary and sufficient level. Thus, just as in the case of the transparent toner and the light black toner, an image can be formed with a stable image density.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-171509 filed Jun. 21, 2006, which is hereby incorporated by reference herein in its entirety.

What is claimed is:

1. An image forming apparatus comprising:

a first development unit configured to develop an electrostatic image using a first developer including a lighter color toner of two toners having different color depths in a same hue;

a second development unit configured to develop an electrostatic image using a second developer including a darker color toner of the two toners having different color depths in a same hue;

a density detection unit configured to detect a detection toner image selectively using the first and second development units;

a replenishment unit configured to replenish the first and second development units with toners based on a result of the detection by the density detection unit; and a controller configured to control a frequency of forming the detection toner image so that a frequency of forming the detection toner image using the first development unit is higher than a frequency of forming the detection toner image using the second development unit.

2. The image forming apparatus according to claim 1, wherein the density detection unit is configured to perform the density detection operation every predetermined number of formed images in each development unit, and wherein the predetermined number of formed images in the first development unit is smaller than the predetermined number of formed images in the second development unit.

3. The image forming apparatus according to claim 1, wherein an amount of toner consumption of the first development unit is larger than an amount of toner consumption of the second development unit in a halftone density area.

4. The image forming apparatus according to claim 1, wherein the halftone density area is an area where an input image signal value is in a range of 100 to 140.

5. An image forming apparatus comprising:

a first development unit configured to develop an electrostatic latent image using a toner for forming at least a color image;

a second development unit configured to develop an electrostatic latent image using a toner for forming a white image or a transparent image;

a density detection unit configured to detect a detection toner image selectively using the first and second development units;

a replenishment unit configured to replenish the first and second development units with toners based on a result of the detection by the density detection unit; and a controller configured to control a frequency of forming the detection toner image so that a frequency of forming the detection toner image using the first development unit is higher than a frequency of forming the detection toner image using the second development unit.

6. The image forming apparatus according to claim 5, wherein the density detection unit is configured to perform the density detection operation every predetermined number of formed images in each development unit, and wherein the predetermined number of formed images in the first development unit is smaller than the predetermined number of formed images in the second development unit.

* * * * *